US009858941B2

(12) United States Patent
Atti et al.

(10) Patent No.: US 9,858,941 B2
(45) Date of Patent: Jan. 2, 2018

(54) SELECTIVE PHASE COMPENSATION IN HIGH BAND CODING OF AN AUDIO SIGNAL

(71) Applicant: QUALCOMM Incorporated, San Diego, CA (US)

(72) Inventors: Venkatraman S. Atti, San Diego, CA (US); Venkata Subrahmanyam Chandra Sekhar Chebiyyam, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 42 days.

(21) Appl. No.: 14/550,589

(22) Filed: Nov. 21, 2014

(65) Prior Publication Data

US 2015/0149156 A1 May 28, 2015

Related U.S. Application Data

(60) Provisional application No. 61/907,674, filed on Nov. 22, 2013.

(51) Int. Cl.

| | |
|---|---|
| ***G10L 21/038*** | (2013.01) |
| ***G10L 19/08*** | (2013.01) |
| ***G10L 19/093*** | (2013.01) |
| ***G10L 19/26*** | (2013.01) |

(52) U.S. Cl.

CPC ..... *G10L 19/265* (2013.01); *G10L 19/08* (2013.01); *G10L 21/038* (2013.01); *G10L 19/093* (2013.01)

(58) Field of Classification Search

CPC ... G10L 19/02; G10L 21/038; G10L 21/0388; G10L 25/03; G10L 19/08; G10L 19/093

USPC ..... 704/203, 205, 206, 500, 501, 219

See application file for complete search history.

(56) References Cited

U.S. PATENT DOCUMENTS

| | | | | |
|---|---|---|---|---|
| 4,433,434 | A * | 2/1984 | Mozer | G10L 19/02 704/211 |
| 6,219,637 | B1 | 4/2001 | Choi et al. | |
| 8,255,228 | B2 | 8/2012 | Hilpert et al. | |
| 8,321,230 | B2 * | 11/2012 | Philippe | G10L 19/022 704/200 |
| 8,484,036 | B2 | 7/2013 | Vos et al. | |
| 2004/0028244 | A1 * | 2/2004 | Tsushima | G10L 21/038 381/98 |
| 2004/0054526 | A1 * | 3/2004 | Chazan | G10L 25/90 704/206 |
| 2004/0078205 | A1 | 4/2004 | Liljeryd et al. | |
| 2006/0149538 | A1 | 7/2006 | Lee et al. | |

(Continued)

FOREIGN PATENT DOCUMENTS

EP 2631906 A1 8/2013

OTHER PUBLICATIONS

International Search Report and Written Opinion—PCT/US2014/066945—ISA/EPO—dated Feb. 20, 2015, 14 pages.

(Continued)

*Primary Examiner* — Martin Lerner
(74) *Attorney, Agent, or Firm* — Toler Law Group, P.C.

(57) ABSTRACT

A method includes determining, at an encoder, phase adjustment parameters based on a high-band residual signal. The method also includes inserting the phase adjustment parameters into an encoded version of the audio signal to enable phase adjustment during reconstruction of the audio signal from the encoded version of the audio signal.

29 Claims, 8 Drawing Sheets

(56) References Cited

U.S. PATENT DOCUMENTS

2007/0033023 A1* 2/2007 Sung ..... G10L 19/24 704/229
2007/0150269 A1* 6/2007 Nongpiur ..... G10L 21/0364 704/226
2007/0238415 A1 10/2007 Sinha et al.
2008/0281604 A1* 11/2008 Choo ..... G10L 19/0208 704/500
2009/0192806 A1* 7/2009 Truman ..... G10L 21/038 704/500
2011/0099004 A1* 4/2011 Krishnan ..... G10L 21/038 704/206
2011/0172998 A1* 7/2011 Nystrom ..... G10L 21/038 704/229
2013/0058498 A1* 3/2013 Disch ..... G10L 21/038 381/97
2013/0226597 A1* 8/2013 Kjoerling ..... G10L 19/07 704/500
2013/0275142 A1* 10/2013 Hatanaka ..... G10L 19/0204 704/500
2015/0149156 A1* 5/2015 Atti ..... G10L 19/265 704/205
2015/0228288 A1* 8/2015 Subasingha ..... G10L 19/0204 704/500
2015/0279384 A1* 10/2015 Atti ..... G10L 21/038 704/223
2017/0084284 A1* 3/2017 Atti ..... G10L 21/038

OTHER PUBLICATIONS

Zhan J., et al., "Bandwidth Extension for China AVS-M standard", Acoustics, Speech and Signal Processing, 2009. ICASSP 2009. IEEE International Conference on , IEEE, Piscataway, NJ , USA, Apr. 19, 2009 (Apr. 19, 2009), pp. 4149-4152, XP031460188, ISBN: 978-1-4244-2353-8.

* cited by examiner

SELECTIVE PHASE COMPENSATION IN HIGH BAND CODING OF AN AUDIO SIGNAL

I. CLAIM OF PRIORITY

The present application claims priority from U.S. Provisional Patent Application No. 61/907,674 entitled "SELECTIVE PHASE COMPENSATION IN HIGH BAND CODING," filed Nov. 22, 2013, the contents of which are incorporated by reference in their entirety.

II. FIELD

The present disclosure is generally related to signal processing.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet Protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player.

In traditional telephone systems (e.g., public switched telephone networks (PSTNs)), signal bandwidth is limited to the frequency range of 300 Hertz (Hz) to 3.4 kilohertz (kHz). In wideband (WB) applications, such as cellular telephony and voice over internet protocol (VoIP), signal bandwidth may span the frequency range from 50 Hz to 7 kHz. Super wideband (SWB) coding techniques support bandwidth that extends up to around 16 kHz. Extending signal bandwidth from narrowband telephony at 3.4 kHz to SWB telephony of 16 kHz may improve the quality of signal reconstruction, intelligibility, and naturalness.

SWB coding techniques typically involve encoding and transmitting the lower frequency portion of the signal (e.g., 50 Hz to 7 kHz, also called the "low-band"). For example, the low-band may be represented using filter parameters and/or a low-band excitation signal. However, in order to improve coding efficiency, the higher frequency portion of the signal (e.g., 7 kHz to 16 kHz, also called the "high-band") may not be fully encoded and transmitted. Instead, a receiver may utilize signal modeling to predict the high-band. In some implementations, data associated with the high-band may be provided to the receiver to assist in the prediction. Such data may be referred to as "side information," and may include gain information, line spectral frequencies (LSFs, also referred to as line spectral pairs (LSPs)), etc. Properties of the low-band signal may be used to generate the side information; however, the side information may not be representative of the high-band because properties of the low-band signal may inaccurately characterize one or more characteristics of the high-band. Inaccurate side information may generate audible artifacts during high-band signal reconstruction at the receiver.

IV. SUMMARY

Systems and methods for performing phase mismatch compensation for improved tracking of high-band temporal characteristics are disclosed. A speech encoder may use properties of a first signal (e.g., a low-band portion of an audio signal) to generate information (e.g., side information) used to reconstruct a high-band portion of the audio signal at a decoder. Examples of the first signal may include a transformed (e.g., non-linear) excitation of the low-band or a high-band excitation based on the transformed excitation to generate the side information.

A phase analyzer may determine phase adjustment parameters to adjust the first signal based on a high-band residual signal that characterizes the high-band of the audio signal. For example, the phase analyzer may utilize domain transformation (e.g., Fast Fourier Transform (FFT)) to determine phase components for selective frequency components (e.g., pitch peaks in the first signal and in the high-band residual signal). Values corresponding to the phase components may be quantized into phase adjustment parameters and provided to a phase adjuster to adjust the phase of the first signal based on the high-band residual signal. As another example, the phase analyzer may generate sinusoidal waveforms that capture spectral peaks of energy of the high-band residual signal. Capturing the spectral peaks of energy may be an efficient way to approximate the phase of the high-band residual signal. Components of the sinusoidal waveforms, such as phase, frequency, and/or amplitude, may be quantized into phase adjustment parameters and provided to the phase adjuster to reconstruct the high-band residual signal. The phase adjustment parameters may be transmitted to the decoder along with other side information to reconstruct the high-band portion of the audio signal.

In a particular embodiment, a method includes determining, at an encoder, phase adjustment parameters based on a high-band residual signal. The method also includes adjusting a phase of a first signal based on the phase adjustment parameters. The first signal may be associated with a low-band portion of an audio signal. The method also includes inserting the phase adjustment parameters into an encoded version of the audio signal to enable phase adjustment during reconstruction of the audio signal from the encoded version of the audio signal. The method further includes transmitting the phase adjustment parameters to a speech decoder as part of a bit stream.

In another particular embodiment, an apparatus includes a phase analyzer configured to determine phase adjustment parameters based on a high-band residual signal. The apparatus also includes a phase adjuster configured to adjust a phase of a first signal based on the phase adjustment parameters. The first signal may be associated with a low-band portion of an audio signal. The apparatus also includes a multiplexer configured to insert the phase adjustment parameters into an encoded version of the audio signal to enable phase adjustment during reconstruction of the audio signal from the encoded version of the audio signal.

In another particular embodiment, a non-transitory computer readable medium includes instructions that, when executed by a processor, cause the processor to determine phase adjustment parameters based on a high-band residual signal. The instructions are also executable to cause the processor to adjust a phase of a first signal based on the phase adjustment parameters. The first signal may be associated with a low-band portion of an audio signal. The instructions are also executable to cause the processor to insert the phase adjustment parameters into an encoded version of the audio signal to enable phase adjustment during reconstruction of the audio signal from the encoded version of the audio signal.

In another particular embodiment, an apparatus includes means for determining phase adjustment parameters based on a high-band residual signal. The apparatus also includes means for adjusting a phase of a first signal based on the phase adjustment parameters, the first signal associated with a low-band portion of an audio signal. The apparatus also includes means for inserting the phase adjustment parameters into an encoded version of the audio signal to enable phase adjustment during reconstruction of the audio signal from the encoded version of the audio signal. The apparatus further includes means for transmitting the phase adjustment parameters to a speech decoder as part of a bit stream.

In another particular embodiment, a method includes receiving, at a decoder, an encoded audio signal from an encoder. The encoded audio signal includes phase adjustment parameters based on a high-band residual signal generated at the encoder. The method further includes generating a reconstructed first signal based on the encoded audio signal, the reconstructed first signal corresponding to a reconstructed version of a first signal generated at the encoder that is associated with a low-band portion of an audio signal. The method also includes applying the phase adjustment parameters to the reconstructed first signal to adjust a phase of the reconstructed first signal. The method further includes reconstructing the audio signal based on the phased-adjusted reconstructed first signal.

In another particular embodiment, an apparatus includes a decoder configured to receive an encoded audio signal from an encoder. The encoded audio signal includes phase adjustment parameters based on a high-band residual signal generated at the encoder. The decoder is further configured to generate a reconstructed first signal based on the encoded audio signal, the reconstructed first signal corresponding to a reconstructed version of a first signal generated at the encoder that is associated with a low-band portion of an audio signal. The decoder is also configured to apply the phase adjustment parameters to the reconstructed first signal to adjust a phase of the reconstructed first signal. The decoder is further configured to reconstruct the audio signal based on the phased-adjusted reconstructed first signal.

In another particular embodiment, an apparatus includes means for receiving an encoded audio signal from an encoder. The encoded audio signal includes phase adjustment parameters based on a high-band residual signal generated at the encoder. The apparatus also includes means for generating a reconstructed first signal based on the encoded audio signal, the reconstructed first signal corresponding to a reconstructed version of a first signal generated at the encoder that is associated with a low-band portion of an audio signal. The apparatus further includes means for applying the phase adjustment parameters to the reconstructed first signal to adjust a phase of the reconstructed first signal. The apparatus also includes means for reconstructing the audio signal based on the phased-adjusted reconstructed first signal.

In another particular embodiment, a non-transitory computer readable medium includes instructions that, when executed by a processor, cause the processor to receive an encoded audio signal from an encoder. The encoded audio signal includes phase adjustment parameters based on a high-band residual signal generated at the encoder to adjust a phase of a first signal generated at the speech encoder. The instructions are further executable to cause the processor to generate a reconstructed first signal based on the encoded audio signal, the reconstructed first signal corresponding to a reconstructed version of a first signal generated at the encoder that is associated with a low-band portion of an audio signal. The instructions are also executable to cause the processor to apply the phase adjustment parameters to the reconstructed first signal to adjust a phase of the reconstructed first signal. The instructions are further executable to cause the processor to reconstruct the audio signal based on the phased-adjusted reconstructed first signal.

Particular advantages provided by at least one of the disclosed embodiments include reducing phase mismatches between a high-band residual signal and a first signal that is used to generate side information that is descriptive of a high-band. For example, the disclosed embodiments may reduce phase mismatches between the high-band residual signal and a harmonically extended signal, or between the high-band residual signal and a high-band excitation signal that is generated from the harmonically extended signal. Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
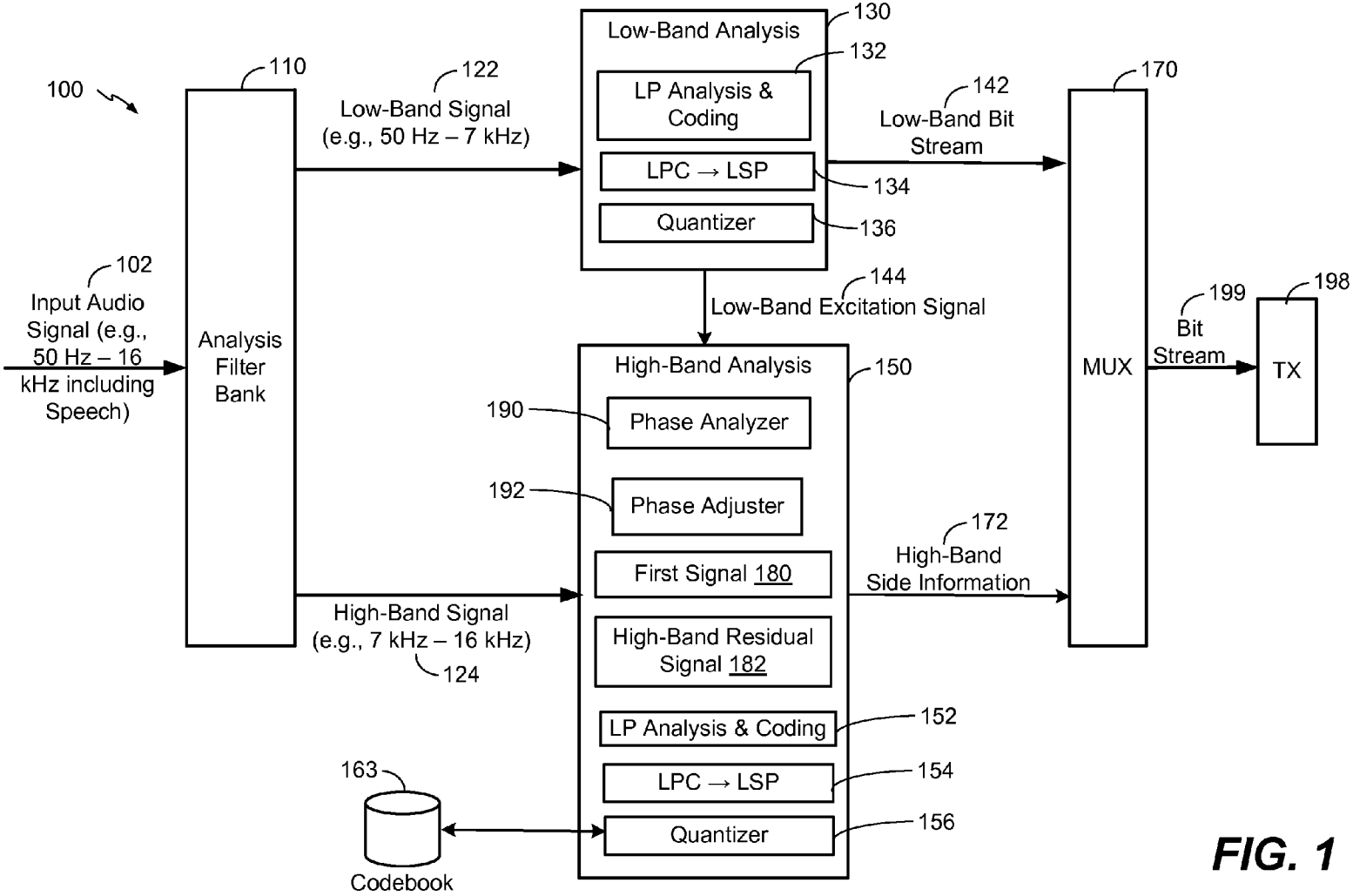
FIG. 1 is a diagram to illustrate a particular embodiment of a system that is operable to determine phase adjustment parameters for high-band reconstruction.

Referring to FIG. 1, a particular embodiment of a system that is operable to determine phase adjustment parameters for high-band reconstruction is shown and generally designated 100. In a particular embodiment, the system 100 may be integrated into an encoding system or apparatus (e.g., in a wireless telephone or coder/decoder (CODEC)). In other embodiments, the system 100 may be integrated into a set top box, a music player, a video player, an entertainment unit, a navigation device, a communications device, a PDA, a fixed location data unit, or a computer.

It should be noted that in the following description, various functions performed by the system 100 of FIG. 1 are described as being performed by certain components or modules. However, this division of components and modules is for illustration only. In an alternate embodiment, a function performed by a particular component or module may instead be divided amongst multiple components or modules. Moreover, in an alternate embodiment, two or more components or modules of FIG. 1 may be integrated into a single component or module. Each component or module illustrated in FIG. 1 may be implemented using hardware (e.g., a field-programmable gate array (FPGA) device, an application-specific integrated circuit (ASIC), a digital signal processor (DSP), a controller, etc.), software (e.g., instructions executable by a processor), or any combination thereof.

The system 100 includes an analysis filter bank 110 that is configured to receive an input audio signal 102. For example, the input audio signal 102 may be provided by a microphone or other input device. In a particular embodiment, the input audio signal 102 may include speech. The input audio signal 102 may be a SWB signal that includes data in the frequency range from approximately 50 Hz to approximately 16 kHz. The analysis filter bank 110 may filter the input audio signal 102 into multiple portions based on frequency. For example, the analysis filter bank 110 may generate a low-band signal 122 and a high-band signal 124. The low-band signal 122 and the high-band signal 124 may have equal or unequal bandwidth, and may be overlapping or non-overlapping. In an alternate embodiment, the analysis filter bank 110 may generate more than two outputs.

In the example of FIG. 1, the low-band signal 122 and the high-band signal 124 occupy non-overlapping frequency bands. For example, the low-band signal 122 and the high-band signal 124 may occupy non-overlapping frequency bands of 50 Hz-7 kHz and 7 kHz-16 kHz, respectively. In an alternate embodiment, the low-band signal 122 and the high-band signal 124 may occupy non-overlapping frequency bands of 50 Hz-8 kHz and 8 kHz-16 kHz, respectively. In another alternate embodiment, the low-band signal 122 and the high-band signal 124 overlap (e.g., 50 Hz-8 kHz and 7 kHz-16 kHz, respectively), which may enable a low-pass filter and a high-pass filter of the analysis filter bank 110 to have a smooth rolloff, which may simplify design and reduce cost of the low-pass filter and the high-pass filter. Overlapping the low-band signal 122 and the high-band signal 124 may also enable smooth blending of low-band and high-band signals at a receiver, which may result in fewer audible artifacts.

It should be noted that although the example of FIG. 1 illustrates processing of a SWB signal, this is for illustration only. In an alternate embodiment, the input audio signal 102 may be a WB signal having a frequency range of approximately 50 Hz to approximately 8 kHz. In such an embodiment, the low-band signal 122 may correspond to a frequency range of approximately 50 Hz to approximately 6.4 kHz and the high-band signal 124 may correspond to a frequency range of approximately 6.4 kHz to approximately 8 kHz.

The system 100 may include a low-band analysis module 130 configured to receive the low-band signal 122. In a particular embodiment, the low-band analysis module 130 may represent an embodiment of a code excited linear prediction (CELP) encoder. The low-band analysis module 130 may include a linear prediction (LP) analysis and coding module 132, a linear prediction coefficient (LPC) to LSP transform module 134, and a quantizer 136. LSPs may also be referred to as LSFs, and the two terms (LSP and LSF) may be used interchangeably herein. The LP analysis and coding module 132 may encode a spectral envelope of the low-band signal 122 as a set of LPCs. LPCs may be generated for each frame of audio (e.g., 20 milliseconds (ms) of audio, corresponding to 320 samples at a sampling rate of 16 kHz), each sub-frame of audio (e.g., 5 ms of audio), or any combination thereof. The number of LPCs generated for each frame or sub-frame may be determined by the "order" of the LP analysis performed. In a particular embodiment, the LP analysis and coding module 132 may generate a set of eleven LPCs corresponding to a tenth-order LP analysis.

The LPC to LSP transform module 134 may transform the set of LPCs generated by the LP analysis and coding module 132 into a corresponding set of LSPs (e.g., using a one-to-one transform). Alternately, the set of LPCs may be one-to-one transformed into a corresponding set of parcor coefficients, log-area-ratio values, immittance spectral pairs (ISPs), or immittance spectral frequencies (ISFs). The transform between the set of LPCs and the set of LSPs may be reversible without error.

The quantizer 136 may quantize the set of LSPs generated by the transform module 134. For example, the quantizer 136 may include or be coupled to multiple codebooks that include multiple entries (e.g., vectors). To quantize the set of LSPs, the quantizer 136 may identify entries of codebooks that are "closest to" (e.g., based on a distortion measure such as least squares or mean square error) the set of LSPs. The quantizer 136 may output an index value or series of index values corresponding to the location of the identified entries in the codebook. The output of the quantizer 136 may thus represent low-band filter parameters that are included in a low-band bit stream 142.

The low-band analysis module 130 may also generate a low-band excitation signal 144. For example, the low-band excitation signal 144 may be an encoded signal that is generated by quantizing a LP residual signal that is generated during the LP process performed by the low-band analysis module 130. The LP residual signal may represent prediction error.

The system 100 may further include a high-band analysis module 150 configured to receive the high-band signal 124 from the analysis filter bank 110 and the low-band excitation signal 144 from the low-band analysis module 130. The high-band analysis module 150 may generate high-band side information 172 based on the high-band signal 124 and the low-band excitation signal 144. For example, the high-band side information 172 may include high-band LSPs, gain information, and/or phase information (e.g., phase adjustment parameters). In a particular embodiment, the phase information may include phase adjustment parameters based on a high-band residual signal 182 that are used to adjust a phase of a first signal 180, as further described herein.

As illustrated, the high-band analysis module 150 may include an LP analysis and coding module 152, a LPC to LSP transform module 154, and a quantizer 156. Each of the LP analysis and coding module 152, the transform module 154, and the quantizer 156 may function as described above with reference to corresponding components of the low-band analysis module 130, but at a comparatively reduced resolution (e.g., using fewer bits for each coefficient, LSP, etc.). The LP analysis and coding module 152 may generate a set of LPCs that are transformed to LSPs by the transform module 154 and quantized by the quantizer 156 based on a codebook 163. For example, the LP analysis and coding module 152, the transform module 154, and the quantizer 156 may use the high-band signal 124 to determine high-band filter information (e.g., high-band LSPs) that is included in the high-band side information 172. The high-band residual signal 182 may correspond to a residual of the LP analysis and coding module 152.

The quantizer 156 may be configured to quantize a set of spectral frequency values, such as LSPs provided by the transform module 154. In other embodiments, the quantizer 156 may receive and quantize sets of one or more other types of spectral frequency values in addition to, or instead of, LSFs or LSPs. For example, the quantizer 156 may receive and quantize a set of LPCs generated by the LP analysis and coding module 152. Other examples include sets of parcor coefficients, log-area-ratio values, and ISFs that may be received and quantized at the quantizer 156. The quantizer 156 may include a vector quantizer that encodes an input vector (e.g., a set of spectral frequency values in a vector format) as an index to a corresponding entry in a table or codebook, such as the codebook 163. As another example, the quantizer 156 may be configured to determine one or more parameters from which the input vector may be generated dynamically at a decoder, such as in a sparse codebook embodiment, rather than retrieved from storage. To illustrate, sparse codebook examples may be applied in coding schemes such as CELP and codecs according to industry standards such as 3 GPP2 (Third Generation Partnership 2) EVRC (Enhanced Variable Rate Codec). In another embodiment, the high-band analysis module 150 may include the quantizer 156 and may be configured to use a number of codebook vectors to generate synthesized signals (e.g., according to a set of filter parameters) and to select one of the codebook vectors associated with the synthesized signal that best matches the high-band signal 124, such as in a perceptually weighted domain.

The high-band analysis module 150 may include a phase analyzer 190. The phase analyzer 190 may be configured to determine phase adjustment parameters based on the high-band residual signal 182 to adjust the phase of the first signal 180. In a first particular embodiment, the phase analyzer 190 may be configured to perform a transform operation on the high-band residual signal 182 to convert the high-band residual signal 182 from a time-domain to a frequency-domain. For example, the phase analyzer 190 may perform a FFT operation on the high-band residual signal 182. Performing the transform operation on the high-band residual signal 182 may include generation of a number of transform coefficients (e.g., 128 Fourier Transform coefficients) that are descriptive of a corresponding number of frequencies (e.g., 128 frequencies) of the high-band residual signal 182. Each transform coefficient may include phase information and amplitude information of the high-band residual signal 182 at a particular frequency. The phase information may be quantized to generate the phase adjustment parameters. For example, a quantizer (not shown) may quantize the phase information into phase adjustment parameters. The phase adjustment parameters may be provided to a phase adjuster 192 (to adjust the phase of the first signal 180 to more closely mimic the phase of the high-band residual signal 182) and to a multiplexer (MUX) 170 as high-band side information 172.

The phase analyzer 190 may be configured to generate a phase adjustment parameter for each frequency, or the phase analyzer 190 may be configured to generate phase adjustment parameters for selective frequencies (e.g., frequencies associated with spectral peaks of the high-band residual signal 182). The spectral peaks may be determined by analyzing the high-band residual signal 182 for outlying (e.g., relatively high and/or relatively low) peaks of energy. As an illustrative non-limiting example, the phase analyzer 190 may generate phase adjustment parameters for frequencies that correspond to multiples of a fundamental pitch frequency for a voiced frame in the high-band (e.g., 7 kHz-16 kHz). For example, a voice frame may have a fundamental pitch frequency of 1.5 kHz. The phase analyzer 190 may generate phase adjustment parameters at multiples of 1.5 kHz (e.g., 7.5 kHz, 9 kHz, 10.5 kHz, etc.) As another illustrative non-limiting example, the phase analyzer 190 may generate phase adjustment parameters for frequencies corresponding to regular intervals of the transform coefficients. As a non-limiting example, the phase analyzer 190 may generate phase adjustment parameters for frequencies corresponding to the $10^{th}$ transform coefficient, the $20^{th}$ transform coefficient, the $30^{th}$ transform coefficient, etc. In another particular embodiment, the phase analyzer 190 may generate phase adjustment parameters for frequencies corresponding to the $5^{th}$ transform coefficient, the $10^{th}$ transform coefficient, the $15^{th}$ transform coefficient, etc. As the intervals decrease (e.g., as more transform coefficients are generated), increased (and more accurate) phase components of the high-band residual signal 182 may be captured.

In a second particular embodiment, the phase analyzer 190 may be configured to generate sinusoidal waveforms that approximate energy levels of the high-band residual signal 182. For example, the phase analyzer 190 may iteratively search for "dominant" sinusoidal waveforms that approximate the energy levels at the spectral peaks of the high-band residual signal 182. The number of sinusoidal waveforms used to approximate the energy levels may be determined based on a tradeoff between approximation accuracy (e.g., reducing a mean square error between the sinusoidal waveforms and the high-band residual signal 182) and an increased bit rate associated with an increased number of sinusoidal waveforms. A phase component, an amplitude component, and a frequency component of each sinusoidal waveform may be quantized and provided to the phase adjuster 192 and to the multiplexer 170 as high-band side information 174. The quantized phase components may correspond to the phase adjustment parameters.

The phase adjuster 192 may be configured to adjust a phase of the first signal 180 based on the phase adjustment parameters. According to the first embodiment described above, the phase adjuster 192 may be configured to perform a transform operation (e.g., an FFT operation) on the first signal 180 to convert the first signal 180 from the time-domain to the frequency-domain. The phase adjuster 192 may replace or adjust the phase components of the first signal 180 (in the frequency-domain) according to the phase adjustment parameters generated by the phase analyzer 190. For example, phase adjustment parameters for the selected frequencies of the high-band residual signal 182 may be applied to corresponding frequencies of the first signal 180. Applying the phase adjustment parameters to the corresponding frequencies of the first signal 180 may replace phase components of the first signal 180 with components extracted from the high-band residual signal 182.

According to the second embodiment described above, the phase adjuster 192 may be configured to generate sinusoidal waveforms that approximate energy of the first signal 180. The phase adjuster 192 may also be configured to generate a residual sinusoidal waveform based on an energy difference between the first signal 180 and the sinusoidal waveforms that approximate the energy levels of the first signal 180. For example, the residual waveform may correspond to remaining energy of the first signal 180 not captured by the sinusoidal waveforms that approximate energy levels of the first signal 180. The phase adjuster 192 may reconstruct the sinusoidal waveforms generated by the phase analyzer 190 using the phase adjustment parameters generated by the phase analyzer 190. The residual sinusoidal waveform may be combined with a scaled version of the reconstructed sinusoidal waveforms, as described with respect to FIG. 3, to adjust the phase of the first signal 180 based on the phase of the high-band residual signal 182.

As described herein, the first signal 180 may be a harmonically extended version (e.g., non-linearly extended version) of the low-band excitation of the low-band signal 122. For example, the low-band excitation signal 144 may undergo an absolute-value operation or a square operation to generate the harmonically extended version of the low-band excitation of the low-band signal 122. Alternatively, the first signal 180 may be a high-band excitation signal that is generated from the harmonically extended version of the low-band excitation of the low-band signal 122. For example, white noise may be mixed with the harmonically extended version of the low-band excitation of the low-band signal 122 to generate the high-band excitation signal.

In a particular embodiment, the high-band side information 172 may include high-band LSPs as well as phase adjustment parameters. For example, the high-band side information 172 may include the phase adjustment parameters generated by the phase analyzer 190.

The low-band bit stream 142 and the high-band side information 172 may be multiplexed by the multiplexer 170 to generate an output bit stream 199. The output bit stream 199 may represent an encoded audio signal corresponding to the input audio signal 102. For example, the multiplexer 170 may be configured to insert the phase adjustment parameters included in the high-band side information 172 into an encoded version of the input audio signal 102 to enable phase adjustment during reconstruction of the input audio signal 102. The output bit stream 199 may be transmitted (e.g., over a wired, wireless, or optical channel) by a transmitter 198 and/or stored. At a receiver, reverse operations may be performed by a demultiplexer (DEMUX), a low-band decoder, a high-band decoder, and a filter bank to generate an audio signal (e.g., a reconstructed version of the input audio signal 102 that is provided to a speaker or other output device). The number of bits used to represent the low-band bit stream 142 may be substantially larger than the number of bits used to represent the high-band side information 172. Thus, most of the bits in the output bit stream 199 may represent low-band data. The high-band side information 172 may be used at a receiver to regenerate the high-band excitation signal from the low-band data in accordance with a signal model. For example, the signal model may represent an expected set of relationships or correlations between low-band data (e.g., the low-band signal 122) and high-band data (e.g., the high-band signal 124). Thus, different signal models may be used for different kinds of audio data (e.g., speech, music, etc.), and the particular signal model that is in use may be negotiated by a transmitter and a receiver (or defined by an industry standard) prior to communication of encoded audio data. Using the signal model, the high-band analysis module 150 at a transmitter may be able to generate the high-band side information 172 such that a corresponding high-band analysis module at a receiver is able to use the signal model to reconstruct the high-band signal 124 from the output bit stream 199.

The system 100 of FIG. 1 may reduce phase mismatches between the high-band residual signal 182 and the first signal 180. For example, the system 100 may reduce mismatches between the high-band residual signal 182 and a harmonically extended signal, or between the high-band residual signal 182 and a high-band excitation signal that is generated from the harmonically extended signal. Reducing phase mismatches may improve gain shape estimation and reduce audible artifacts during high-band reconstruction of the input audio signal 102. For example, reducing the phase mismatches may improve timing alignments of the first signal 180 (e.g., low-band portions of the input audio signal 102 that are used to generate a synthesized version of the high-band signal 124) and the high-band residual signal 182. Aligning the first signal 180 and the high-band residual signal 182 may enable more accurate gain shape estimations between the first signal 180 and the high-band residual signal 182. The phase adjustment parameters may be transmitted to a decoder to reduce audible artifacts during high-band reconstruction of the input audio signal 102.

Figure 2:
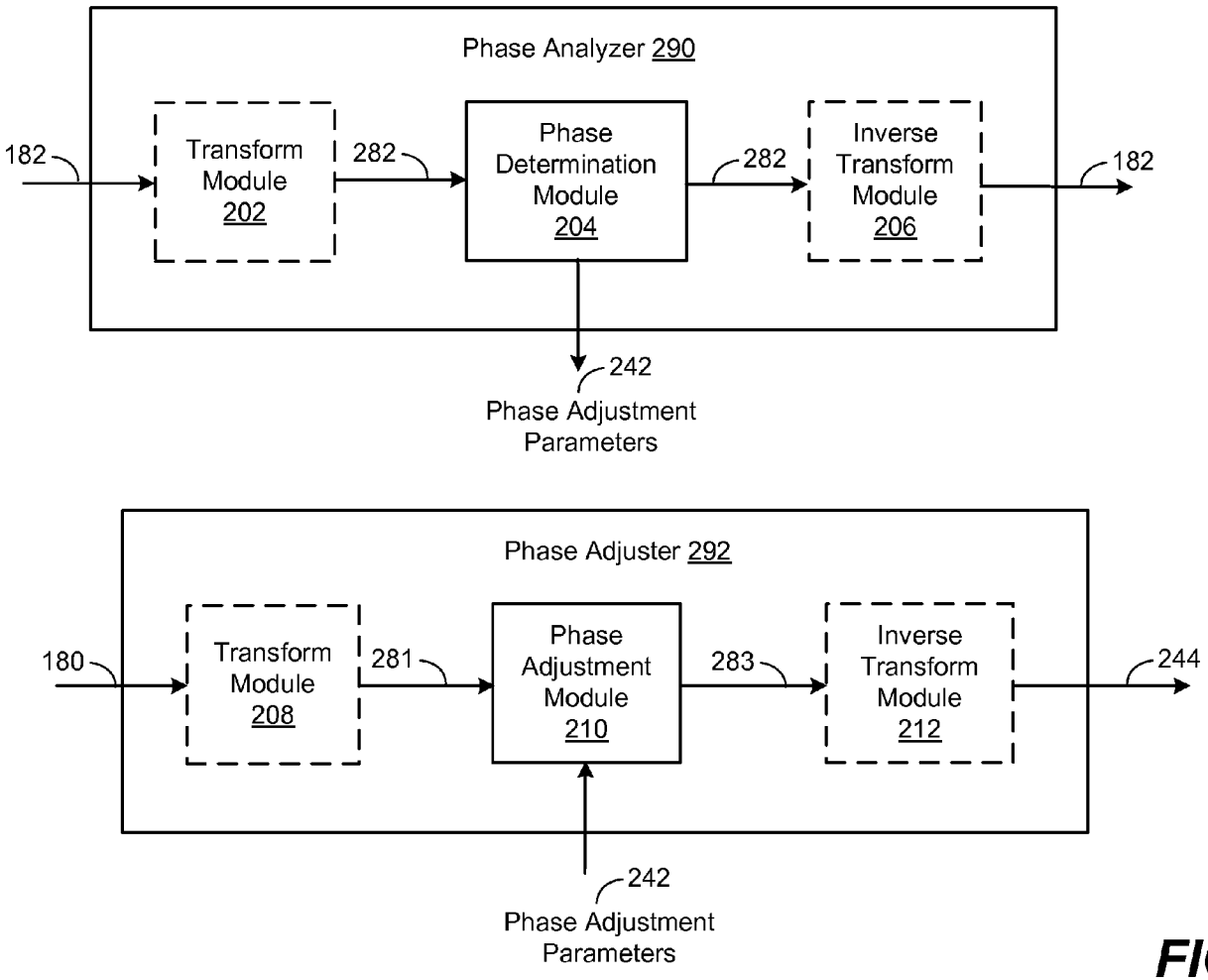
FIG. 2 is a diagram to illustrate particular embodiments of a phase analyzer and a phase adjuster.

Referring to FIG. 2, particular embodiments of a phase analyzer 290 and a phase adjuster 292 are shown. The phase analyzer 290 may correspond to the phase analyzer 190 of FIG. 1 and the phase adjuster 292 may correspond to the phase adjuster 192 of FIG. 1. The phase analyzer 290 includes a phase determination module 204, and the phase adjuster 292 includes a phase adjustment module 210. In a particular embodiment, the phase analyzer 290 may also include a first transform module 202 and a first inverse transform module 206. Although the inverse transform module 206 is depicted in the phase analyzer 290 of FIG. 2, in alternate embodiments, the inverse transform module 206 may be absent from the phase analyzer 290. In a particular embodiment, the phase adjuster 292 may also include a second transform module 208 and a second inverse transform module 212.

The first transform module 202 may be configured to convert the high-band residual signal 182 of FIG. 1 from a time-domain into a frequency-domain (e.g., transform domain). For example, the first transform module 202 may perform a FFT operation on the high-band residual signal 182 to convert the high-band residual signal 182 into a frequency-domain high-band residual signal 282.

The frequency-domain high-band residual signal 282 may be represented by transform coefficients that represent signal characteristics within particular frequency bands (e.g., frequencies). Each transform coefficient may include phase information for a particular frequency and amplitude information for the particular frequency. As an illustrative non-limiting example, the frequency-domain high-band residual signal 282 may include frequencies that range from 7 kHz to 16 kHz and may be represented using 128 FFT coefficients. Each FFT coefficient may include phase information associated with the high-band residual signal 182 at different frequencies between 7 kHz and 16 kHz. The phase information may be quantized by a quantizer (not shown) as phase adjustment parameters 242 and provided to the phase adjuster 292.

In some implementations, the phase determination module 204 may be configured to determine phase adjustment parameters 242 for frequencies corresponding to selective FFT coefficients (e.g., particular transform coefficients) as opposed to determining phase adjustment parameters for frequencies corresponding to each FFT coefficient. For example, the phase determination module 204 may determine phase adjustment parameters 242 for frequencies that correspond to integer multiples of a fundamental pitch frequency for a voiced frame in the high-band (e.g., 7 kHz-16 kHz).

As another example, the phase determination module 204 may determine phase adjustment parameters 242 for frequencies corresponding to FFT coefficients at particular intervals. As a non-limiting example, phase adjustment parameters 242 may be determined for a first interval of frequencies corresponding to every $10^{th}$ FFT coefficient, and the phase determination module 204 may determine whether a particular threshold of spectral peaks (e.g., 50% of the spectral peaks) of the high-band residual signal 182 are captured using the first interval. In response to a determination that the particular threshold is not satisfied, phase adjustment parameters 242 may be determined for a second interval of frequencies, such as corresponding to every $4^{th}$ FFT coefficient (e.g., a higher resolution), to satisfy the particular threshold. Thus, intervals of the frequencies may be adjusted to generate phase adjustment parameters 242 that capture the particular threshold of spectral peaks. Data corresponding to the interval may also be quantized and transmitted to the phase adjuster 292 (and to the multiplexer 170) along with the phase adjustment parameters 242.

The first inverse transform module 206 may be configured to convert the frequency-domain high-band residual signal 282 back to the time-domain. For example, the first inverse transform module 206 may perform an Inverse Fast Fourier Transform (IFFT) operation on the frequency-domain high-band residual signal 282 to convert the frequency-domain high-band residual signal 282 back into the high-band residual signal 182 (e.g., a time-domain signal). Alternatively, the phase analyzer 290 may not include the first inverse transform module 206 when the (non-transformed) high-band residual signal 182 is available to be used for additional processing.

The second transform module 208 may operate in a substantially similar manner as the first transform module 202. For example, the second transform module 208 may be configured to convert the first signal 180 from the time-domain into the frequency-domain to generate a frequency-domain first signal 281. The frequency-domain first signal 281 may be provided to the phase adjustment module 210 along with the phase adjustment parameters 242 from the phase determination module 204. The phase adjustment module 210 may be configured to replace phase components of the frequency-domain first signal 281 according to the phase adjustment parameters 242. For example, the phase adjustment module 210 may replace phases of the frequency-domain first signal 281 with phases of the frequency-domain high-band residual signal at the selected frequencies (e.g., the selected intervals) to generate an adjusted frequency-domain first signal 283. The phases of components of the frequency-domain first signal 281 may be replaced by replacing the phase components of the FFT representation of the high-band residual signal 182 with the phase components of the frequency-domain first signal 281 (e.g., the FFT representation of the first signal 180).

The second inverse transform module 212 may operate in a substantially similar manner as the first inverse transform module 206. For example, the second inverse transform module 212 may be configured to convert the adjusted frequency-domain first signal 283 from the frequency-domain to the time-domain to generate a phase-adjusted signal 244.

Using the transform modules 202, 208 to convert the high-band residual signal 182 and the first signal 180, respectively, from the time-domain to the frequency-domain enables phase components (e.g., phase adjustment parameters 242) at particular frequencies of the high-band residual signal 182 to be determined and applied to the first signal 180. Applying the phase components of the high-band residual signal 182 to the first signal 180 may offset phase mismatches between the high-band residual signal 182 and the first signal 180 that may otherwise result in audible artifacts.

In another particular embodiment, the phase analyzer 290 may determine phase mismatches between the first signal 180 and the high-band residual signal 182. For example, the first transform module 202 may determine transform coefficients for the first signal 180 and corresponding transform coefficients for the high-band residual signal 182. The phase determination module 204 may determine a magnitude of phase mismatch for selective frequency components (e.g., pitch peaks in the first signal 180 and the high-band residual signal 182). The magnitude of the phase mismatch may be quantized into phase adjustment parameters 242 and provided to the phase adjuster 292 to adjust the phase of the first signal 180 based on the phase mismatch.

In a particular embodiment, the phase adjuster 292 may adjust the phase of the first signal 180 at multiple frequencies. For example, the phase adjuster 292 may adjust the phase of the first signal 180 based on the phase of the high-band residual signal 182 at a first frequency corresponding to a first transform coefficient of the first signal 180 and the high-band residual signal. The phase adjuster 292 may also adjust the phase of the first signal 180 based on the phase of the high-band residual signal 182 at a second frequency corresponding to a second transform coefficient of the first signal 180 and the high-band residual signal 182.

Figure 3:
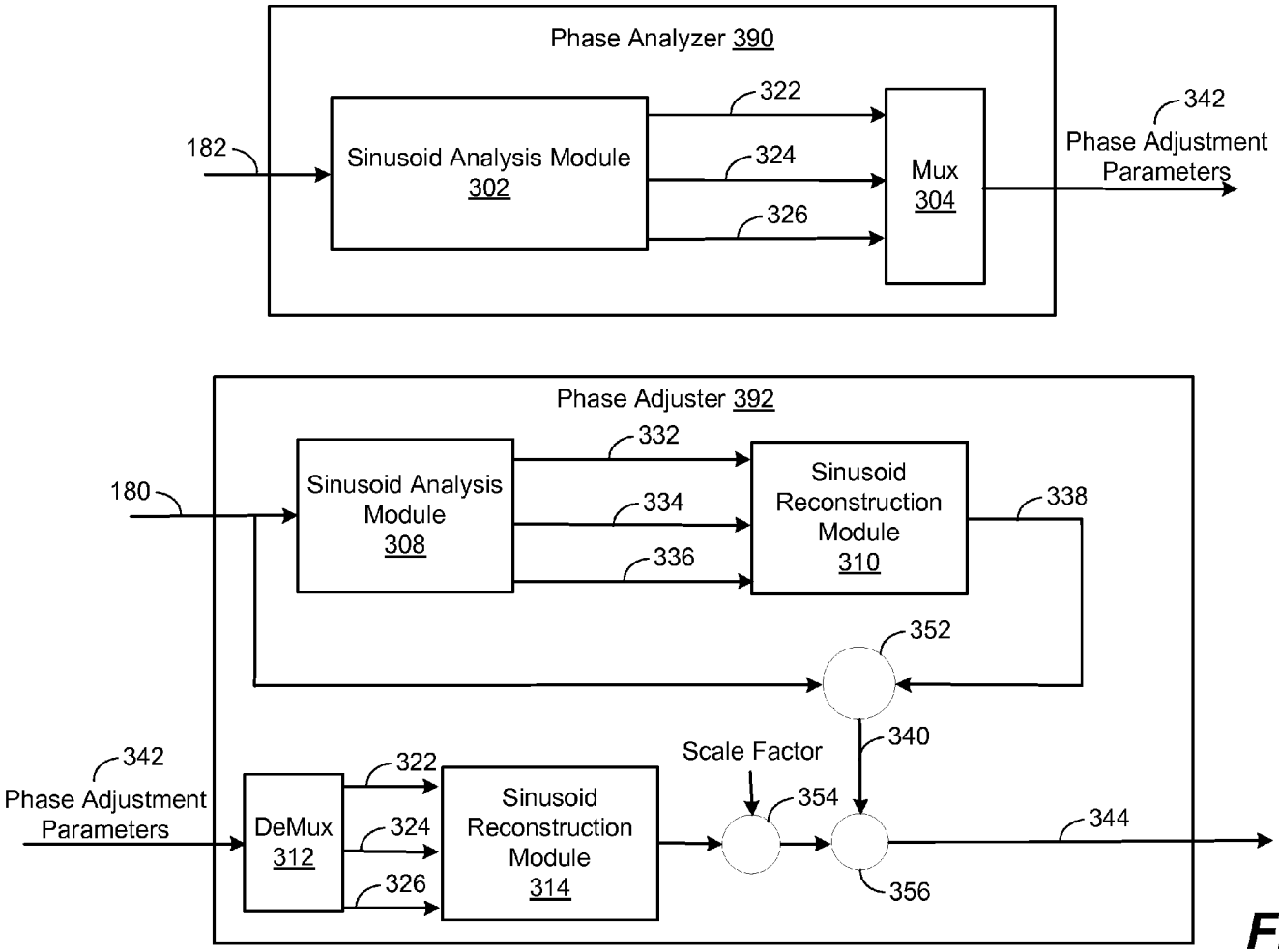
FIG. 3 is a diagram to illustrate other particular embodiments of a phase analyzer and a phase adjuster.

Referring to FIG. 3, particular embodiments of a phase analyzer 390 and a phase adjuster 392 are shown. The phase analyzer 390 may correspond to the phase analyzer 190 of FIG. 1, and the phase adjuster 392 may correspond to the phase adjuster 192 of FIG. 1. The phase analyzer 390 includes a first sinusoid analysis module 302 and a multiplexer (MUX) 304. The phase adjuster 392 includes a second sinusoid analysis module 308, a first sinusoid reconstruction module 310, a demultiplexer (DeMUX) 312, and a second sinusoid reconstruction module 314.

The high-band residual signal 182 may be provided to the first sinusoid analysis module 302. The first sinusoidal analysis module 302 may be configured to detect energy levels at particular time instances (e.g., time-domain analysis) or at particular frequencies (e.g., frequency-domain analysis) of the high-band residual signal 182. Based on the detected energy levels, the first sinusoid analysis module 302 may be configured to generate sinusoidal waveforms that approximate the energy levels. For example, the first sinusoid analysis module 302 may generate sinusoidal waveforms that can be combined to capture a specific portion (e.g., spectral peaks) of the detected energy levels. As used herein, "dominant" sinusoidal waveforms may correspond to sinusoidal waveforms that capture spectral peaks of a signal being approximated. The first sinusoid analysis module 302 may be configured to generate phase information 322 of the dominant sinusoids. In a particular embodiment, the first sinusoid analysis module 302 may also generate amplitude information 324 and frequency information 326 of the dominant sinusoids. The information 322-326 may be quantized by a quantizer (not shown) and combined by the multiplexer 304 as phase adjustment parameters 342.

The first signal 180 may be provided to the second sinusoid analysis module 308 and to a first mixer 352. The second analysis module 308 may operate in a substantially similar manner as the first sinusoid analysis module 302. For example, the second sinusoid analysis module 308 may generate phase information 332, amplitude information 334, and frequency information 336 of sinusoids having energy levels that approximate energy levels of the first signal 180. The information 322-336 may be provided to the first sinusoid reconstruction module 310.

The first sinusoid reconstruction module 310 may be configured to reconstruct the first signal 180 as sinusoidal waveforms 338. For example, the sinusoidal waveforms 338 may approximate energy levels of the first signal 180 based on the information 322-336. The sinusoidal waveforms 338 are provided to the first mixer 352. The first mixer 352 may subtract components of the sinusoidal waveforms 338 from the first signal 180 to generate a residual waveform 340 that approximates an energy difference between the sinusoidal waveforms 338 and the first signal 180.

The phase adjustment parameters 342 may be provided to the demultiplexer 312. The demultiplexer 312 may generate the phase information 322, the amplitude information 324, and the frequency information 326 of the dominate sinusoidal waveforms that approximate the energy level of the high-band residual signal 182. The information 322-326 may be provided to the second sinusoid reconstruction module 314. The second sinusoid reconstruction module 314 may operate in a substantially similar manner as the first sinusoid reconstruction module 310. For example, the second reconstruction module 314 may be configured to reconstruct the sinusoidal waveforms that approximate the energy levels of the high-band residual signal 182 based on the information 322-326, and may provide the reconstructed sinusoidal waveforms to a second mixer 354 (e.g., a scaler/multiplier). The second mixer 354 may scale reconstructed sinusoidal waveforms based on a scale factor to generate scaled reconstructed sinusoidal waveforms. The scale factor is typically used to normalize the energies of reconstructed sinusoids associated with the first signal 180 (i.e., the harmonically extended version of the low-band excitation of the low-band signal or the high band excitation) and the energies of reconstructed sinusoids associated with the high band residual signal 182. The residual waveform 340 is mixed with the scaled reconstructed sinusoidal waveforms at a mixer 356 to generate a phase-adjusted first signal 344.

The phase analyzer 390 and the phase adjuster 392 of FIG. 3 may reduce phase mismatches between the high-band residual signal 182 and the first signal 180. The phase adjustment parameters 342 may be included in side information that is descriptive of a high-band. Reducing phase mismatches may improve gain shape estimation and reduce audible artifacts during high-band reconstruction of the input audio signal 102. For example, reducing the phase mismatches may improve timing alignments of the first signal 180 (e.g., low-band portions of the input audio signal 102 that are used to generate a synthesized version of the high-band signal 124) and the high-band residual signal 182. Aligning the first signal 180 and the high-band residual signal 182 may enable more accurate gain shape estimations between the first signal 180 and the high-band residual signal 182.

Figure 4:
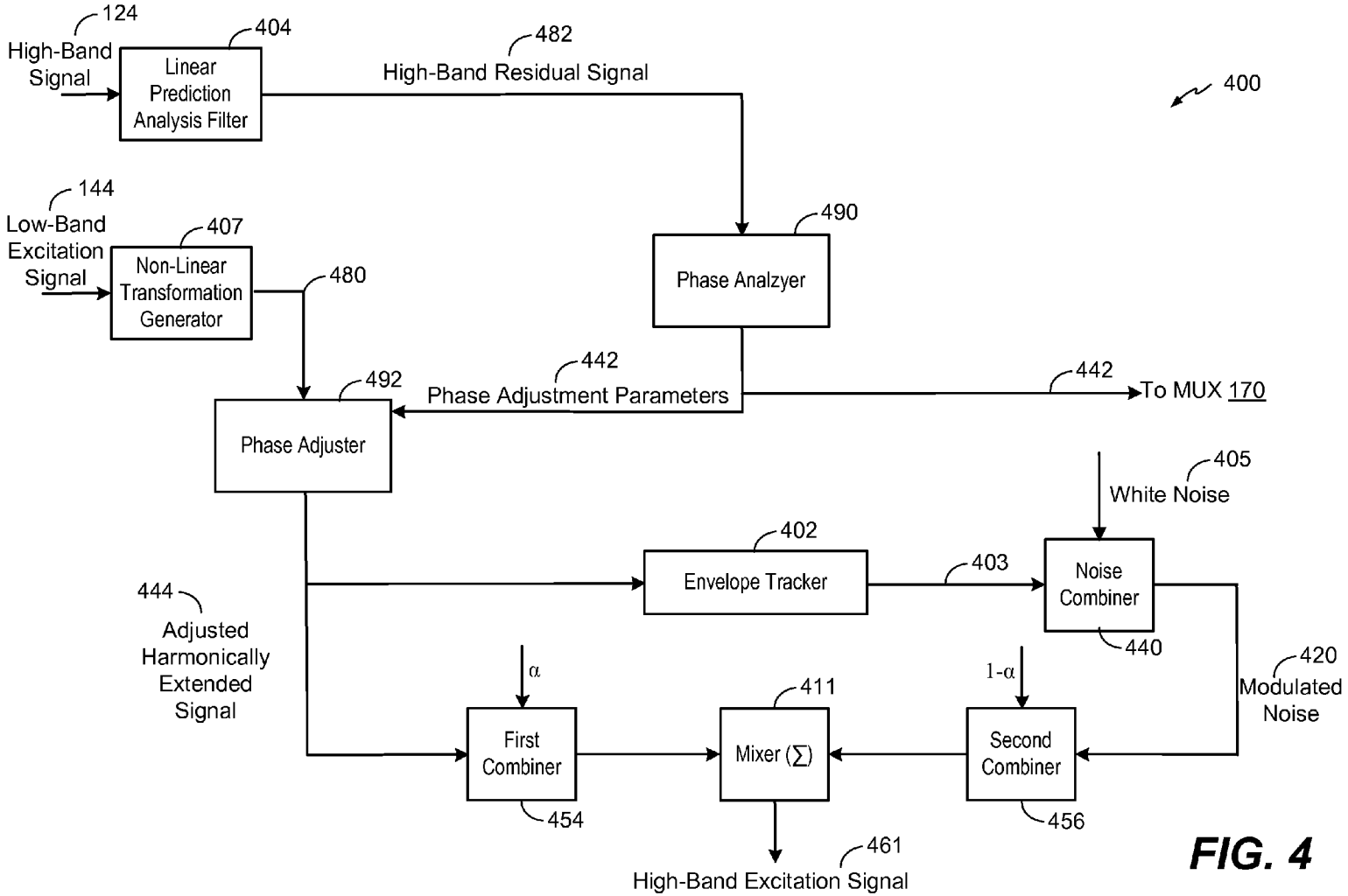
FIG. 4 is a diagram to illustrate a particular embodiment of a system that is operable to determine phase adjustment parameters for high-band reconstruction.

Referring to FIG. 4, a particular embodiment of a system 400 that is operable to determine phase adjustment parameters for high-band reconstruction is shown. The system 400 includes a linear prediction analysis filter 404, a non-linear transformation generator 407, a phase analyzer 490, and a phase adjuster 492.

The low-band excitation signal 144 may be provided to the non-linear transformation generator 407. As described with respect to FIG. 1, the low-band excitation signal 144 may be generated from the low-band signal 122 (e.g., the low-band portion of the input audio signal 102) using the low-band analysis module 130. The non-linear transformation generator 407 may be configured to generate a harmonically extended signal 480 based on the low-band excitation signal 144. For example, the non-linear transformation generator 407 may perform an absolute-value operation or a square operation on frames (or sub-frames) of the low-band excitation signal 144 to generate the harmonically extended signal 480.

To illustrate, the non-linear transformation generator 407 may up-sample the low-band excitation signal 144 (e.g., an 8 kHz signal ranging from approximately 0 kHz to 8 kHz) to generate a 16 kHz signal ranging from approximately 0 kHz to 16 kHz (e.g., a signal having approximately twice the bandwidth of the low-band excitation signal 144). A low-band portion of the 16 kHz signal (e.g., approximately from 0 kHz to 8 kHz) may have substantially similar harmonics as the low-band excitation signal 144, and a high-band portion of the 16 kHz signal (e.g., approximately from 8 kHz to 16 kHz) may be substantially free of harmonics. The non-linear transformation generator 407 may extend the "dominant" harmonics in the low-band portion of the 16 kHz signal to the high-band portion of the 16 kHz signal to generate the harmonically extended signal 480. Thus, the harmonically extended signal 480 may be a harmonically extended version of the low-band excitation signal 144 that extends into the high-band using non-linear operations (e.g., square operations and/or absolute value operations). The harmonically extended signal 480 may be provided to the phase adjuster 492. The harmonically extended signal 480 may correspond to the first signal 180 of FIG. 1.

The high-band signal 124 may be provided to the linear prediction analysis filter 404. The linear prediction analysis filter 404 may be configured to generate a high-band residual signal 482 based on the high-band signal 124 (e.g., a high-band portion of the input audio signal 102). For example, the linear prediction analysis filter 404 may encode a spectral envelope of the high-band signal 124 as a set of LPCs used to predict future samples of the high-band signal 124. The high-band residual signal 482 may be provided to the phase analyzer 490. The high-band residual signal 482 may correspond to the high-band residual signal 182 of FIG. 1.

The phase analyzer 490 may correspond to, and may operate in a substantially similar manner as, the phase analyzer 190 of FIG. 1, the phase analyzer 290 of FIG. 2, or the phase analyzer 390 of FIG. 3. For example, the phase analyzer 490 may generate phase adjustment parameters 442 based on the high-band residual signal 482. The phase adjustment parameters 442 may correspond to the phase adjustment parameters 242 of FIG. 2 or the phase adjustment parameters 342 of FIG. 3. The phase adjustment parameters 442 may be provided to the phase adjuster 492 and to the multiplexer 170 of FIG. 1 as high-band side information 172.

The phase adjuster 492 may correspond to, and may operate in a substantially similar manner as, the phase adjuster 192 of FIG. 1, the phase adjuster 292 of FIG. 2, or the phase adjuster 392 of FIG. 3. For example, the phase adjuster 492 may adjust a phase of the harmonically extended signal 480 based on the phase adjustment parameters 442 to generate an adjusted harmonically extended signal 444. The adjusted harmonically extended signal 444 may be provided to an envelope tracker 402 and to a first combiner 454.

The envelope tracker 402 may be configured to receive the adjusted harmonically extended signal 444 and to calculate a low-band time-domain envelope 403 corresponding to the adjusted harmonically extended signal 444. For example, the envelope tracker 402 may be configured to calculate the square of each sample of a frame of the adjusted harmonically extended signal 444 to produce a sequence of squared values. The envelope tracker 402 may be configured to perform a smoothing operation on the sequence of squared values, such as by applying a first order infinite impulse response (IIR) low-pass filter to the sequence of squared values. The envelope tracker 402 may be configured to apply a square root function to each sample of the smoothed sequence to produce the low-band time-domain envelope 403. The low-band time-domain envelope 403 may be provided to a noise combiner 440.

The noise combiner 440 may be configured to combine the low-band time-domain envelope 403 with white noise 405 generated by a white noise generator (not shown) to produce a modulated noise signal 420. For example, the noise combiner 440 may be configured to amplitude-modulate the white noise 405 according to the low-band time-domain envelope 403. In a particular embodiment, the noise combiner 440 may be implemented as a multiplier that is configured to scale the white noise 405 according to the low-band time-domain envelope 403 to produce the modulated noise signal 420. The modulated noise signal 420 may be provided to a second combiner 456.

The first combiner 454 may be implemented as a multiplier that is configured to scale the adjusted harmonically extended signal 444 according to the mixing factor (a) to generate a first scaled signal. The second combiner 456 may be implemented as a multiplier that is configured to scale the modulated noise signal 420 based on the mixing factor (a) to generate a second scaled signal. For example, the second combiner 456 may scale the modulated noise signal 420 based on the difference of one minus the mixing factor (e.g., $1-\alpha$). The first scaled signal and the second scaled signal may be provided to the mixer 411.

The mixer 411 may generate a high-band excitation signal 461 based on the mixing factor (a), the adjusted harmonically extended signal 444, and the modulated noise signal 420. For example, the mixer 411 may mix the first scaled signal and the second scaled signal to generate the high-band excitation signal 461.

The system 400 of FIG. 4 may adjust the phase of the harmonically extended signal 480 based on the phase adjustment parameters 442 to improve high-band reconstruction. Adjusting the phase of the harmonically extended signal 480 may reduce phase mismatches between the high-band residual signal 482 and the harmonically extended signal 480. Reducing phase mismatches may improve gain shape estimation and reduce audible artifacts during high-band reconstruction. For example, reducing the phase mismatches may improve timing alignments of the harmonically extended signal 480 and the high-band residual signal 482. Aligning the harmonically extended signal 480 and the high-band residual signal 482 may enable more accurate gain shape estimations between the harmonically extended signal 480 and the high-band residual signal 482.

Figure 5:
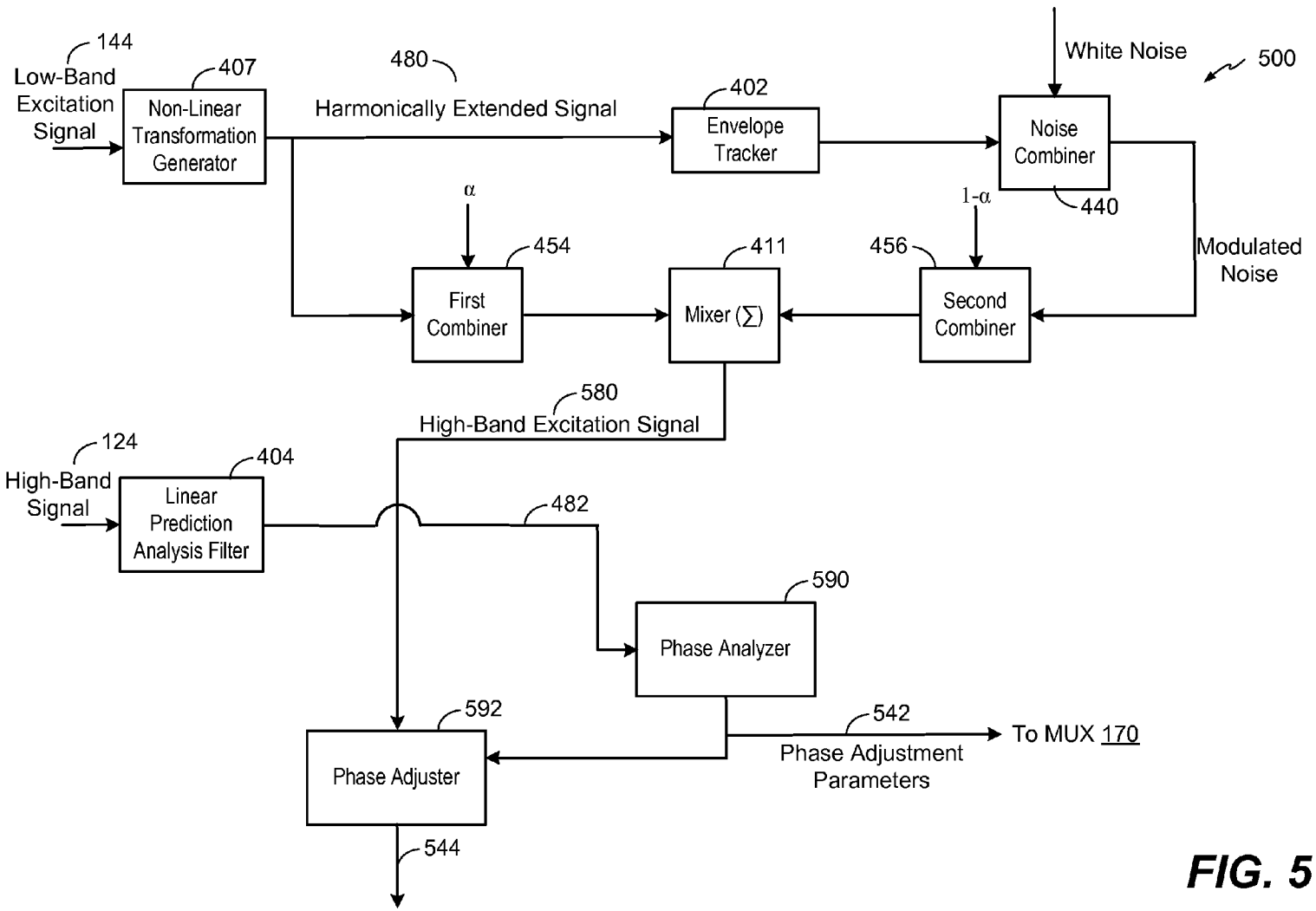
FIG. 5 is a diagram to illustrate another particular embodiment of a system that is operable to determine phase adjustment parameters for high-band reconstruction.

Referring to FIG. 5, a particular illustrative embodiment of a system 500 that is operable to determine phase adjustment parameters for high-band reconstruction is shown. The system 500 may include components described with respect to FIG. 4, such as the non-linear transformation generator 407, the envelope tracker 402, the noise combiner 440, the first combiner 454, the second combiner 456, and the mixer 411. The components described with respect to FIG. 4 may generate a high-band excitation signal 580 based on the harmonically extended signal 480, instead of the high-band excitation signal 461 based on the adjusted harmonically extended signal 444. The high-band excitation signal 580 may correspond to the first signal 180 of FIG. 1.

The system 500 may also include the linear prediction analysis filter 404 of FIG. 4. The high-band signal 124 may be provided to the linear prediction analysis filter 404, and the linear prediction analysis filter 404 may be configured to generate the high-band residual signal 482 based on the high-band signal 124. The high-band residual signal 482 may correspond to the high-band residual signal 182 of FIG. 1.

The system 500 may also include a phase analyzer 590. The phase analyzer 590 may correspond to, and may operate in a substantially similar manner as, the phase analyzer 190 of FIG. 1, the phase analyzer 290 of FIG. 2, or the phase analyzer 390 of FIG. 3. For example, the phase analyzer 590 may generate phase adjustment parameters 542 based on the high-band residual signal 482. The phase adjustment parameters 542 may correspond to the phase adjustment parameters 242 of FIG. 2 or the phase adjustment parameters 342 of FIG. 3. The phase adjustment parameters 542 may be provided to a phase adjuster 592 and to the multiplexer 170 of FIG. 1 as high-band side information 172.

The phase adjuster 592 may correspond to, and may operate in a substantially similar manner as, the phase adjuster 192 of FIG. 1, the phase adjuster 292 of FIG. 2, or the phase adjuster 392 of FIG. 3. For example, the phase adjuster 592 may adjust a phase of the high-band excitation signal 580 based on the phase adjustment parameters 542 to generate an adjusted high-band excitation signal 544.

The system 500 of FIG. 5 may improve high-band reconstruction by adjusting the phase of the high-band excitation signal 580 based on the phase adjustment parameters 542. Adjusting the phase of the high-band excitation signal 580 may reduce phase mismatches between the high-band residual signal 482 and the high-band excitation signal 580. Adjusting the phase of the high-band excitation signal 580 (instead of the phase of the harmonically extended signal 480 of FIG. 4) may reduce phase degradation caused by noise, such as the white noise 405 of FIG. 4. Reducing phase mismatches may improve gain shape estimation and reduce audible artifacts during high-band reconstruction.

Figure 6:
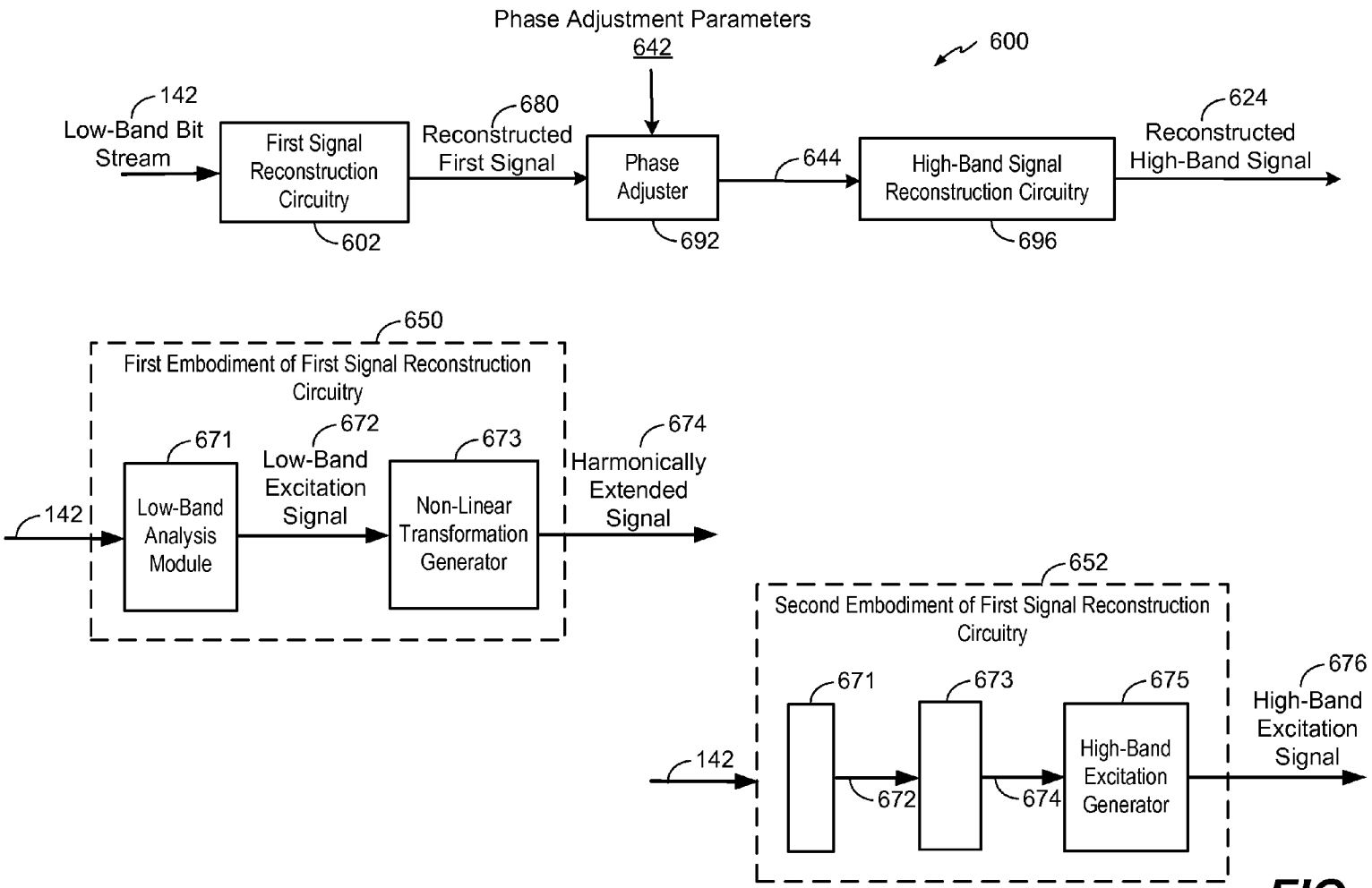
FIG. 6 is a diagram to illustrate a particular embodiment of a system that is operable to reconstruct an audio signal using phase adjustment parameters.

Referring to FIG. 6, a particular embodiment of a system 600 that is operable to reconstruct an audio signal using phase adjustment parameters is shown. The system 600 includes first signal reconstruction circuitry 602 and a phase adjuster 692. In a particular embodiment, the system 600 may be integrated into a decoding system or apparatus (e.g., in a wireless telephone or CODEC). In other particular embodiments, the system 600 may be integrated into a set top box, a music player, a video player, an entertainment unit, a navigation device, a communications device, a PDA, a fixed location data unit, or a computer.

The first signal reconstruction circuitry 602 may receive the low-band bit stream 142 of FIG. 1 and may be configured to generate a reconstructed first signal 680 (e.g., a reconstructed version of the first signal 180 of FIGS. 1-3, a reconstructed version of the harmonically extended signal 480 of FIG. 4, a reconstructed version of the high-band excitation signal 580 of FIG. 5, or any combination thereof) based on the low-band bit stream 142. For example, the first signal reconstruction circuitry 602 may include similar components to the components included in the low-band analysis module 130 of FIG. 1. In addition, the first signal reconstruction circuitry 602 may include one or more components of the high-band analysis module 150 of FIG. 1. The reconstructed first signal 680 may be provided to the phase adjuster 692.

A first embodiment 650 of the first signal reconstruction circuitry 602 may include a low-band analysis module 671 and a non-linear transformation generator 673. The low-band analysis module 671 may include similar components to the components included in the low-band analysis module 130 of FIG. 1 and may operate in a substantially similar manner. For example, the low-band analysis module 671 may generate a low-band excitation signal 672 based on the low-band bit stream 142. The low-band excitation signal 672 may be provided to the non-linear transformation generator 673. The non-linear transformation generator 673 may operate in a substantially similar manner as the non-linear transformation generator 407 of FIG. 4. For example, the non-linear transformation generator 673 may generate a harmonically extended signal 674 (e.g., the reconstructed first signal 680 according to the first embodiment 650 of the first signal reconstruction circuitry 602).

A second embodiment 652 of the first signal reconstruction circuitry 602 may include the low-band analysis module 671, the non-linear transformation generator 673, and a high-band excitation generator 675. The harmonically extended signal 674 may be provided to the high-band excitation generator 675. The high-band excitation generator 675 may generate a high-band excitation signal 676 (e.g., the reconstructed first signal 680 according to the second embodiment 652 of the first signal reconstruction circuitry 602) based on the harmonically extended signal 674.

Phase adjustment parameters 642 may also be provided to the phase adjuster 692. The phase adjustment parameters 642 may correspond to any of the phase adjustment parameters 242-542 of FIGS. 2-5. For example, the high-band side information 172 of FIG. 1 may include data representing the phase adjustment parameters 642, and the data representing the phase adjustment parameters 642 may be transmitted to the system 600. The phase adjuster 692 may be configured to adjust the reconstructed first signal 680 based on the phase adjustment parameters 642 to generate an adjusted reconstructed first signal 644. In a particular embodiment, the phase adjuster 692 may operate in a substantially similar manner as any of the phase adjusters 192-592 of FIGS. 1-5. The adjusted reconstructed first signal 644 may be provided to high-band signal reconstruction circuitry 696. The high-band signal reconstruction circuitry 696 may perform temporal/frame gain adjustment, synthesis filtering, or any combination thereof, to generate a reconstructed high-band signal 624. The reconstructed high-band signal 624 may be a reconstructed version of the high-band signal 124 of FIG. 1.

The system 600 of FIG. 6 may reconstruct the high-band signal 124 using the first signal 180 and the phase adjustment parameters 642. Using the phase adjustment parameters 642 may improve accuracy of reconstruction by adjusting the reconstructed first signal 680 based on temporal evolutions of energy of the high-band residual signal 182 detected at the speech encoder. For example, the phase of the adjusted reconstructed first signal 644 may approximate the phase of the high-band residual signal 182. The high-band signal reconstruction circuitry 696 may more accurately adjust the gain of the adjusted reconstructed first signal 644 based on gain shape parameters (not shown) associated with the high-band that is provided via the high-band side information 172 when the phases of the adjusted reconstructed first signal 644 and the high-band residual signal 182 are approximately equal.

Figure 7:
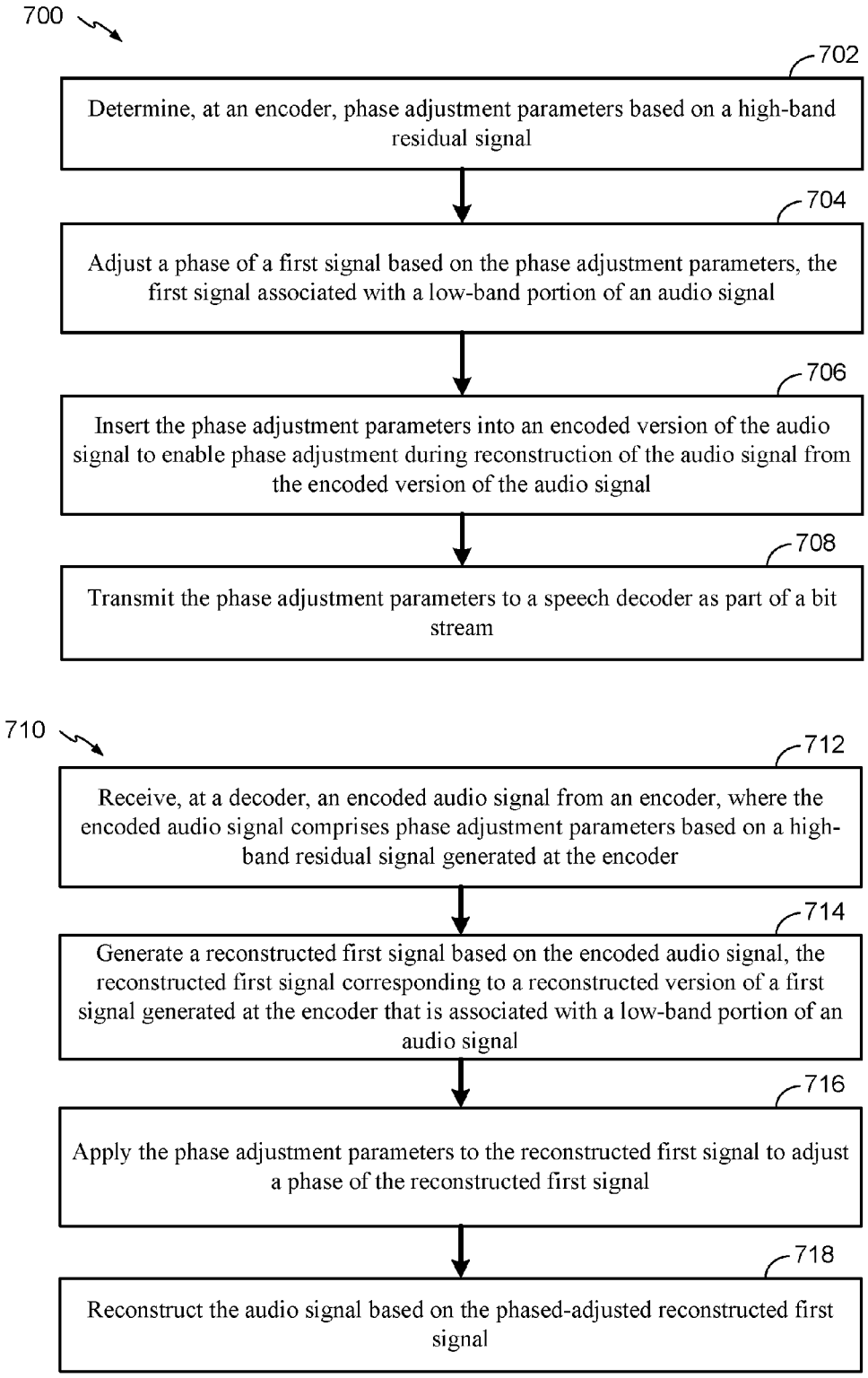
FIG. 7 depicts flowcharts to illustrate particular embodiments of methods of using phase adjustment parameters for high-band reconstruction.

Referring to FIG. 7, flowcharts of particular embodiments of methods 700, 710 of using phase adjustment parameters for high-band reconstruction are shown. The first method 700 may be performed by the system 100 of FIG. 1, the phase analyzers 190-590 of FIGS. 1-5, the phase adjusters 192-592 of FIGS. 1-5, and the systems 400-500 of FIGS. 4-5. The second method 710 may be performed by the system 600 of FIG. 6.

The first method 700 includes determining, at an encoder, phase adjustment parameters based on a high-band residual signal, at 702. For example, referring to FIG. 1, the phase analyzer 190 may determine phase adjustment parameters based on the high-band residual signal 182 to adjust the phase of the first signal 180. In a first particular embodiment, the phase analyzer 190 may be configured to perform a transform operation on the high-band residual signal 182 to convert the high-band residual signal 182 from a time-domain to a frequency-domain. Transform coefficients of the converted high-band residual signal 182 may include phase information and amplitude information of the high-band residual signal 182 at respective frequencies. The phase information may be quantized to generate the phase adjustment parameters, and the phase adjustment parameters may be provided to a phase adjuster 192 (to adjust the phase of the first signal 180 to mimic the phase of the high-band residual signal 182 at selective frequencies).

In a second particular embodiment, the phase analyzer 190 may generate sinusoidal waveforms that approximate energy levels of the high-band residual signal 182. For example, the phase analyzer 190 may iteratively search for dominant sinusoidal waveforms that capture the energy levels of spectral peaks of the high-band residual signal 182, such as described with respect to FIG. 3. A phase component, an amplitude component, and a frequency component of each sinusoidal waveform may be quantized and provided to the phase adjuster 192 and to the multiplexer 170 as high-band side information 172. The quantized phase components may correspond to the phase adjustment parameters.

A phase of a first signal may be adjusted based on the phase adjustment parameters, at 704. The first signal may be associated with a low-band portion of an audio signal. For example, referring to FIG. 1, the phase adjuster 192 may adjust the phase of the first signal 180 to more closely mimic the phase of the high-band residual signal 182.

The phase adjustment parameters may be inserted into an encoded version of the audio signal to enable phase adjustment during reconstruction of the audio signal from the encoded version of the audio signal, at 706. For example, the high-band side information 172 of FIG. 1 may include one or more of the phase adjustment parameters 242-542 of FIGS. 2-5. The multiplexer 170 may insert the phase adjustment parameters into the bit stream 199.

The phase adjustment parameters may be transmitted to a speech decoder as part of a bit stream, at 708. For example, referring to FIG. 1, the bit stream 199 (including the phase adjustment parameters) may be transmitted to a decoder (e.g., the system 600 of FIG. 6).

The first method 700 may generate phase adjustment parameters that are provided to a decoder along with a low-band excitation signal. The decoder may generate a reconstructed version of the high-band signal 124 of FIG. 1 based on the phase adjustment parameters and the low-band excitation signal. For example, providing the high-band signal 124 to the decoder may utilize a relatively large amount of bandwidth; however, providing the low-band excitation signal and the phase adjustment parameters may utilize a smaller amount of bandwidth. The decoder may use the phase adjustment parameters to adjust signals generated from the low-band excitation signal (e.g., a harmonically extended signal as described with respect to FIG. 4 at the encoder and/or the high-band excitation signal as described with respect to FIG. 5 at the encoder) to mimic the phase of the high-band signal 124. Mimicking the phase of the high-band signal 124 may improve timing alignments at the decoder. The improved timing alignments may enable more accurate gain adjustments at the decoder to generate the reconstructed version of the high-band signal 124. While the first method 700 is directed towards encoder functions, the second method 710 is directed towards decoder functions.

The second method 710 may include receiving, at a decoder, an encoded audio signal from a speech encoder, at 712. The encoded audio signal may include the phase adjustment parameters 642 (e.g., one or more of the phase adjustment parameters 242-542 of FIGS. 2-5) based on the high-band residual signal 182 generated at the speech encoder to adjust the phase of the first signal 180 generated at the speech encoder.

A reconstructed first signal may be generated based on the encoded audio signal, at 714. The reconstructed first signal may correspond to a reconstructed version of a first signal generated at the encoder that is associated with a low-band portion of an audio signal. For example, referring to FIG. 6, the first signal reconstruction circuitry 602 may generate the reconstructed first signal 680 based on the low-band bit stream 142 from the encoder.

The phase adjustment parameters may be applied to the reconstructed first signal to adjust a phase of the reconstructed first signal, at 716. For example, referring to FIG. 6, the phase adjuster 692 may apply the phase adjustment parameters 642 to the reconstructed first signal 680 to adjust the phase of the reconstructed first signal 680.

An audio signal may be reconstructed based on the phase-adjusted reconstructed first signal, at 718. For example, the phase adjuster 692 of FIG. 6 may adjust the phase of the reconstructed first signal 680 based on the phase adjustment parameters 642 to generate the phase-adjusted reconstructed first signal 644. The phase-adjusted reconstructed first signal 644 may be provided to high-band signal reconstruction circuitry 696. The high-band signal reconstruction circuitry 696 may perform temporal/frame gain adjustment, synthesis filtering, or any combination thereof, to generate a reconstructed high-band signal 624. The reconstructed high-band signal 624 may be a reconstructed version of the high-band signal 124 of FIG. 1.

The methods 700, 710 of FIG. 7 may reduce phase mismatches between the high-band residual signal 182 and the first signal 180 that is used to generate the high-band side information 172. For example, the system 100 may reduce phase mismatches between the high-band residual signal 182 and a harmonically extended signal, or between the high-band residual signal 182 and a high-band excitation signal that is generated from the harmonically extended signal. Reducing phase mismatches may improve gain shape estimation and reduce audible artifacts during high-band reconstruction of the input audio signal 102. The phase adjustment parameters may be transmitted to a decoder to reduce audible artifacts during high-band reconstruction of the input audio signal 102.

In particular embodiments, the methods 700, 710 of FIG. 7 may be implemented via hardware (e.g., a FPGA device, an ASIC, etc.) of a processing unit, such as a central processing unit (CPU), a DSP, or a controller, via a firmware device, or any combination thereof. As an example, the methods 700, 710 of FIG. 7 can be performed by a processor that executes instructions, as described with respect to FIG. 8.

Figure 8:
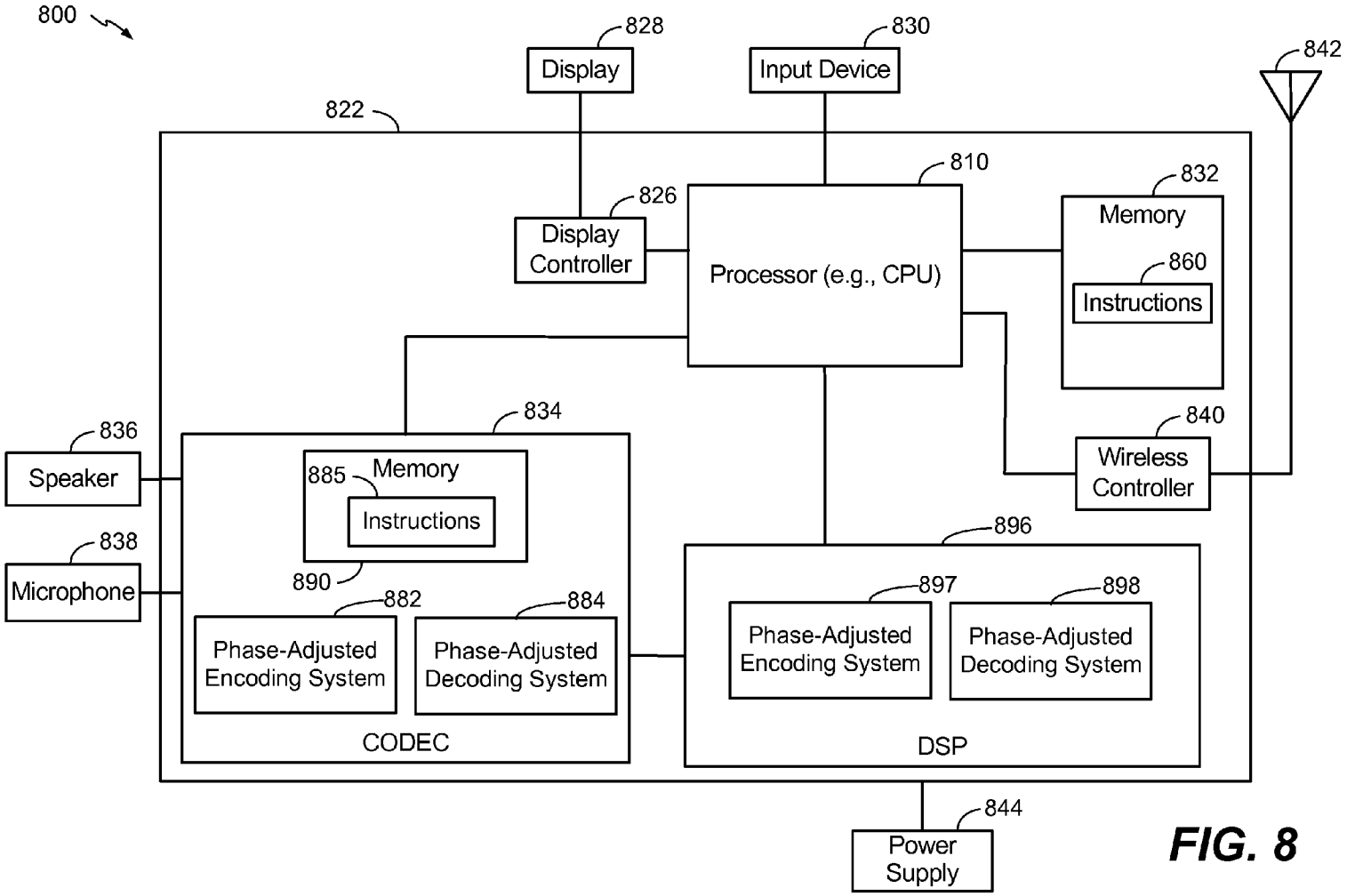
FIG. 8 is a block diagram of a wireless device operable to perform signal processing operations in accordance with the systems and methods of FIGS. 1-7.

Referring to FIG. 8, a block diagram of a particular illustrative embodiment of a wireless communication device is depicted and generally designated 800. The device 800 includes a processor 810 (e.g., a CPU) coupled to a memory 832. The memory 832 may include instructions 860 executable by the processor 810 and/or a CODEC 834 to perform methods and processes disclosed herein, such as the methods 700, 710 of FIG. 7.

In a particular embodiment, the CODEC 834 may include a phase-adjusted encoding system 882 and a phase-adjusted decoding system 884. In a particular embodiment, the phase-adjusted encoding system 882 includes one or more components of the system 100 of FIG. 1, the phase analyzer 290 of FIG. 2, the phase adjuster 292 of FIG. 2, the phase analyzer 390 of FIG. 3, the phase adjuster 392 of FIG. 3, and/or one or more components of the systems 400-500 of FIGS. 4-5. For example, the phase-adjusted encoding system 882 may perform encoding operations associated with the system 100 of FIG. 1, the phase analyzer 290 of FIG. 2, the phase adjuster 292 of FIG. 2, the phase analyzer 390 of FIG. 3, the phase adjuster 392 of FIG. 3, the systems 400-500 of FIGS. 4-5, and the method 700 of FIG. 7. In a particular embodiment, the phase-adjusted decoding system 884 may include one or more components of the system 600 of FIG. 6. For example, the phase-adjusted decoding system 884 may perform decoding operations associated with the system 600 of FIG. 6 and the method 710 of FIG. 7.

The phase-adjusted encoding system 882 and/or the phase-adjusted decoding system 884 may be implemented via dedicated hardware (e.g., circuitry), by a processor executing instructions to perform one or more tasks, or a combination thereof. As an example, the memory 832 or a memory 890 in the CODEC 834 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 860 or the instructions 885) that, when executed by a computer (e.g., a processor in the CODEC 834 and/or the processor 810), may cause the computer to perform one of the methods 700, 710 of FIG. 7. As an example, the memory 832 or the memory 890 in the CODEC 834 may be a non-transitory computer-readable medium that includes instructions (e.g., the instructions 860 or the instructions 885, respectively) that, when executed by a computer (e.g., a processor in the CODEC 834 and/or the processor 810), cause the computer to perform one or more of the methods 700, 710 of FIG. 7.

The device 800 may also include a DSP 896 coupled to the CODEC 834 and to the processor 810. In a particular embodiment, the DSP 896 may include a phase-adjusted encoding system 897 and a phase-adjusted decoding system 898. In a particular embodiment, the phase-adjusted encoding system 897 includes one or more components of the system 100 of FIG. 1, the phase analyzer 290 of FIG. 2, the phase adjuster 292 of FIG. 2, the phase analyzer 390 of FIG. 3, the phase adjuster 392 of FIG. 3, and/or one or more components of the systems 400-500 of FIGS. 4-5. For example, the phase-adjusted encoding system 897 may perform encoding operations associated with the system 100 of FIG. 1, the phase analyzer 290 of FIG. 2, the phase adjuster 292 of FIG. 2, the phase analyzer 390 of FIG. 3, the phase adjuster 392 of FIG. 3, the systems 400-500 of FIGS. 4-5, and the method 700 of FIG. 7. In a particular embodiment, the phase-adjusted decoding system 898 may include one or more components of the system 600 of FIG. 6. For example, the phase-adjusted decoding system 898 may perform decoding operations associated with the system 600 of FIG. 6 and the method 710 of FIG. 7.

FIG. 8 also shows a display controller 826 that is coupled to the processor 810 and to a display 828. The CODEC 834 may be coupled to the processor 810, as shown. A speaker 836 and a microphone 838 can be coupled to the CODEC 834. For example, the microphone 838 may generate the input audio signal 102 of FIG. 1, and the CODEC 834 may generate the output bit stream 199 for transmission to a receiver based on the input audio signal 102. As another example, the speaker 836 may be used to output a signal reconstructed by the CODEC 834 from the output bit stream 199 of FIG. 1, where the output bit stream 199 is received from another device. FIG. 8 also indicates that a wireless controller 840 can be coupled to the processor 810 and to an antenna 842.

In a particular embodiment, the processor 810, the display controller 826, the memory 832, the CODEC 834, and the wireless controller 840 are included in a system-in-package or system-on-chip device (e.g., a mobile station modem (MSM)) 822. In a particular embodiment, an input device 830, such as a touchscreen and/or keypad, and a power supply 844 are coupled to the system-on-chip device 822. Moreover, in a particular embodiment, as illustrated in FIG. 8, the display 828, the input device 830, the speaker 836, the microphone 838, the antenna 842, and the power supply 844 are external to the system-on-chip device 822. However, each of the display 828, the input device 830, the speaker 836, the microphone 838, the antenna 842, and the power supply 844 can be coupled to a component of the system-on-chip device 822, such as an interface or a controller.

In conjunction with the described embodiments, a first apparatus is disclosed that includes means for determining phase adjustment parameters based on a high-band residual signal to adjust a phase of a first signal associated with a low-band portion of an audio signal. For example, the means for determining the phase adjustment parameters may include any one of the phase analyzers 190-590 of FIGS. 1-5, the phase-adjusted encoding system 882 of FIG. 8, the CODEC 834 of FIG. 8, the phase-adjusted encoding system 897 of FIG. 8, one or more devices configured to determine the phase adjustment parameters (e.g., a processor executing instructions at a non-transitory computer readable storage medium), or any combination thereof.

The first apparatus may also include means for inserting the phase adjustment parameters into an encoded version of the audio signal to enable phase adjustment during reconstruction of the audio signal from the encoded version of the audio signal. For example, the means for inserting the phase adjustment parameters into the encoded version of the audio signal may include the multiplexer 170 of FIG. 1, the phase-adjusted encoding system 882 of FIG. 8, the CODEC 834 of FIG. 8, phase-adjusted encoding system 897 of FIG. 8, one or more devices configured to insert the phase adjustment parameters into the encoded version of the audio signal, (e.g., a processor executing instructions at a non-transitory computer readable storage medium), or any combination thereof.

In conjunction with the described embodiments, a second apparatus is disclosed that includes means for receiving an encoded audio signal from an encoder, wherein the encoded audio signal comprises phase adjustment parameters based on a high-band residual signal generated at the encoder. The phase adjustment parameters are usable to adjust a phase of a first signal generated at the speech encoder. For example, the means for receiving the encoded audio signal may include the first signal reconstruction circuitry 602 of FIG. 6, the phase adjuster 692 of FIG. 6, the phase-adjusted decoding system 884 of FIG. 8, a receiver, the CODEC 834 of FIG. 8, the phase-adjusted decoding system 898 of FIG. 8, one or more devices configured to receive the encoded audio signal, (e.g., a processor executing instructions at a non-transitory computer readable storage medium), or any combination thereof.

The second apparatus may also include means for reconstructing an audio signal from the encoded audio signal based on the phase adjustment parameters. For example, the means for reconstructing the audio signal may include the first signal reconstruction circuitry 602 of FIG. 6, the phase adjuster 692 of FIG. 6, the high-band signal reconstruction circuitry 696 of FIG. 6, the phase-adjusted decoding system 884 of FIG. 8, the CODEC 834 of FIG. 8, the phase-adjusted decoding system 898 of FIG. 8, one or more devices configured to reconstruct the audio signal, (e.g., a processor executing instructions at a non-transitory computer readable storage medium), or any combination thereof.

Those of skill would further appreciate that the various illustrative logical blocks, configurations, modules, circuits, and algorithm steps described in connection with the embodiments disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an ASIC. The ASIC may reside in a computing device or a user terminal. In the alternative, the processor and the storage medium may reside as discrete components in a computing device or a user terminal.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A method comprising:

generating a high-band residual signal based on performing a linear prediction analysis on a high-band portion of an audio signal;

determining, at an encoder, phase adjustment parameters based on the high-band residual signal, wherein at least one phase adjustment parameter of the phase adjustment parameters is based at least in part on a first sinusoidal waveform that approximates an energy level of the high-band residual signal;

adjusting, at the encoder, a phase of a first signal based on the phase adjustment parameters, the first signal based on a low-band portion of the audio signal, wherein a phase-adjusted first signal is generated based at least in part on a second sinusoidal waveform that approximates an energy level of the first signal;

inserting the phase adjustment parameters into an encoded version of the audio signal to enable phase adjustment during reconstruction of the audio signal from the encoded version of the audio signal, the encoded version of the audio signal including side information based on the first signal after the phase is adjusted; and transmitting the phase adjustment parameters in the encoded version of the audio signal to a speech decoder as part of a bit stream.

2. The method of claim 1, further comprising:

generating the first signal based on a harmonically extended signal or based on a high-band excitation signal that is generated from the harmonically extended signal, the harmonically extended signal based on the low-band portion of the audio signal.

3. The method of claim 1, wherein determining a particular phase adjustment parameter comprises determining a particular phase of the high-band residual signal at a particular frequency, and wherein the particular phase adjustment parameter includes quantized information associated with the particular phase of the high-band residual signal at the particular frequency.

4. The method of claim 3, wherein determining the particular phase of the high-band residual signal at the particular frequency comprises:

performing a transform operation on the high-band residual signal to convert the high-band residual signal from a time domain to a frequency domain, wherein the transform operation corresponds to a Fast Fourier Transform operation; and selecting a particular transform coefficient of the converted high-band residual signal, wherein the particular transform coefficient is associated with the particular frequency, and wherein the particular phase is determined based on the particular transform coefficient.

5. The method of claim 3, wherein adjusting the phase of the first signal comprises adjusting a first phase of the first signal at the particular frequency based on the particular phase adjustment parameter.

6. The method of claim 5, wherein adjusting the first phase of the first signal at the particular frequency comprises:

performing a transform operation on the first signal to convert the first signal from a time domain to a frequency domain;

replacing the first phase of the first signal at the particular frequency with an adjusted phase that corresponds to the particular phase of the high-band residual signal at the particular frequency while the first signal is in the frequency domain to produce a phase-adjusted signal; and performing an inverse transform operation on the phase-adjusted signal to convert the phase-adjusted signal from the frequency domain to the time domain.

7. The method of claim 1, further comprising:

generating the first sinusoidal waveform;

determining a particular phase of the first sinusoidal waveform, wherein the at least one phase adjustment parameter is based at least in part on the particular phase of the first sinusoidal waveform;

generating the second sinusoidal waveform;

generating a residual waveform that approximates an energy difference between the second sinusoidal waveform and the first signal;

reconstructing the first sinusoidal waveform based on the particular phase adjustment parameter to generate a reconstructed sinusoidal waveform; and combining the residual waveform with the reconstructed sinusoidal waveform to generate the phase-adjusted first signal.

8. The method of claim 1, wherein the phase of the first signal is adjusted to align a phase of the first signal with a phase of the high-band residual signal for at least a particular frequency range.

9. The method of claim 1, wherein the side information includes estimated gain shape data.

10. The method of claim 1, wherein a first phase adjustment parameter of the phase adjustment parameters is based at least in part on a sinusoidal waveform that approximates an energy level of the high-band residual signal.

11. An apparatus comprising:

a phase analyzer configured to determine phase adjustment parameters based on a high-band residual signal, the high-band residual signal based on a linear prediction analysis performed on a high-band portion of an audio signal, wherein at least one phase adjustment parameter of the phase adjustment parameters is based at least in part on a first sinusoidal waveform that approximates an energy level of the high-band residual signal;

a phase adjuster configured to adjust a phase of a first signal based on the phase adjustment parameters, the first signal based on a low-band portion of the audio signal, wherein a phase-adjusted first signal is generated based at least in part on a second sinusoidal waveform that approximates an energy level of the first signal; and a multiplexer configured to insert the phase adjustment parameters into an encoded version of the audio signal to enable phase adjustment during reconstruction of the audio signal from the encoded version of the audio signal, the encoded version of the audio signal including side information based on the first signal after the phase is adjusted.

12. The apparatus of claim 11, further comprising:

a high-band analysis module that includes a first linear prediction analysis and coding module and that is configured to generate the high-band residual signal; and a transmitter configured to transmit the phase adjustment parameters in the encoded version of the audio signal to a speech decoder as part of a bit stream.

13. The apparatus of claim 11, wherein the first signal is a harmonically extended signal or a high-band excitation signal that is generated from the harmonically extended signal.

14. The apparatus of claim 11, wherein the phase analyzer is configured to determine a particular phase of the high-band residual signal at a particular frequency, and wherein a particular phase adjustment parameter includes quantized information associated with the particular phase of the high-band residual signal at the particular frequency.

15. The apparatus of claim 14, wherein determining the particular phase of the high-band residual signal at the particular frequency comprises:

performing a transform operation on the high-band residual signal to convert the high-band residual signal from a time domain to a frequency domain; and selecting a particular transform coefficient of the converted high-band residual signal, wherein the particular transform coefficient is associated with the particular frequency, and wherein the particular phase is determined based on the particular transform coefficient.

16. The apparatus of claim 14, wherein the phase adjuster is configured to adjust a first phase of the first signal at the particular frequency based on the particular phase adjustment parameter, and wherein the phase adjuster is further configured to:

perform a transform operation on the first signal to convert the first signal from a time-domain to a frequency-domain;

replace the first phase of the first signal at the particular frequency with the particular phase of the high-band residual signal at the particular frequency while the first signal is in the frequency-domain to produce a phase-adjusted signal; and perform an inverse transform operation on the phase-adjusted signal to convert the phase-adjusted signal from the frequency-domain to the time-domain.

17. The apparatus of claim 11, further comprising:

an antenna; and a transmitter coupled to the antenna and configured to transmit the encoded version of the audio signal.

18. The apparatus of claim 17, wherein the phase analyzer, the phase adjuster, the multiplexer, and the transmitter are integrated in a mobile device.

19. The apparatus of claim 14, wherein the particular frequency corresponds to a multiple of a speech fundamental pitch frequency in a high-band portion of the audio signal.

20. The apparatus of claim 14, wherein the phase analyzer is configured to determine phase adjustment parameters at regular frequency intervals, and wherein the particular frequency corresponds to a frequency defined by an interval of the regular frequency intervals.

21. An apparatus comprising:

means for determining phase adjustment parameters based on a high-band residual signal, the high-band residual signal based on a linear prediction analysis performed on a high-band portion of an audio signal, wherein at least one phase adjustment parameter of the phase adjustment parameters is based at least in part on a first sinusoidal waveform that approximates an energy level of the high-band residual signal;

means for adjusting a phase of a first signal based on the phase adjustment parameters, the first signal based on a low-band portion of an audio signal, wherein a phase-adjusted first signal is generated based at least in part on a second sinusoidal waveform that approximates an energy level of the first signal;

means for inserting the phase adjustment parameters into an encoded version of the audio signal to enable phase adjustment during reconstruction of the audio signal from the encoded version of the audio signal, the encoded version of the audio signal including side information based on the first signal after the phase is adjusted; and means for transmitting the phase adjustment parameters in the encoded version of the audio signal to a speech decoder as part of a bit stream.

22. The apparatus of claim 21, further comprising:

means for performing a first analysis on the low-band portion of the audio signal, wherein the means for performing the first analysis comprises a first linear prediction analysis and coding module and is configured to generate a linear prediction residual signal based on the first analysis, wherein the first signal is a harmonically extended signal or a high-band excitation signal that is generated from the harmonically extended signal.

23. The apparatus of claim 22, wherein the means for determining, the means for adjusting, the means for inserting, and the means for transmitting are integrated into a mobile device.

24. The apparatus of claim 21, wherein the means for determining comprises means for determining a particular phase of the high-band residual signal at a particular frequency, and wherein the means for determining the particular phase of the high-band residual signal at the particular frequency comprises:

means for performing a transform operation on the high-band residual signal to convert the high-band residual signal from a time domain to a frequency domain; and means for selecting a particular transform coefficient of the converted high-band residual signal, wherein the particular transform coefficient is associated with the particular frequency, and wherein the particular phase is determined based on the particular transform coefficient.

25. The apparatus of claim 24, wherein the transform operation corresponds to a Fast Fourier Transform operation, and wherein the particular frequency corresponds to a multiple of a speech fundamental pitch frequency in a high-band portion of the audio signal.

26. An apparatus comprising:

a decoder configured to:

receive an encoded audio signal from an encoder, wherein the encoded audio signal comprises phase adjustment parameters based on a high-band residual signal generated via a linear prediction analysis performed on a high-band portion of an audio signal at the encoder, wherein at least one phase adjustment parameter of the phase adjustment parameters is based at least in part on a first sinusoidal waveform that approximates an energy level of the high-band residual signal, and wherein the encoded audio signal further comprises side information based on a first signal generated at the encoder;

generate a reconstructed signal based on the encoded audio signal, the reconstructed signal corresponding to a reconstructed version of the first signal, wherein the first signal is based on a low-band portion of the audio signal, wherein a phase-adjusted first signal is generated based at least in part on a second sinusoidal waveform that approximates an energy level of the first signal;

apply the phase adjustment parameters to the reconstructed signal to adjust a phase of the reconstructed signal; and reconstruct the audio signal based on the phased-adjusted reconstructed signal and based on the side information.

27. The apparatus of claim 26, wherein the linear prediction analysis is performed by a linear prediction analysis and coding module of a high-band analysis module of the encoder, and the reconstructed signal is a harmonically extended signal or a high-band excitation signal that is generated from a harmonically extended signal.

28. The apparatus of claim 26, further comprising:

an antenna; and a receiver coupled to the antenna and configured to receive the encoded audio signal.

29. The apparatus of claim 28, wherein the decoder and the receiver are integrated into a mobile device.

* * * * *